US009322542B2

(12) United States Patent
Stoneham

(10) Patent No.: US 9,322,542 B2
(45) Date of Patent: Apr. 26, 2016

(54) VERSATILE SEALED LED LAMP

(76) Inventor: Edward Bryant Stoneham, Los Altos, CA (US)

( * ) Notice: Subject to any disclaimer, the term of this patent is extended or adjusted under 35 U.S.C. 154(b) by 0 days.

(21) Appl. No.: 13/261,152

(22) PCT Filed: Aug. 11, 2010

(86) PCT No.: PCT/US2010/045236

§ 371 (c)(1),
(2), (4) Date: Jan. 26, 2012

(87) PCT Pub. No.: WO2011/019856

PCT Pub. Date: Feb. 17, 2011

(65) Prior Publication Data

US 2012/0127707 A1 May 24, 2012

Related U.S. Application Data

(60) Provisional application No. 61/233,417, filed on Aug. 12, 2009.

(51) Int. Cl.

| | |
|---|---|
| ***F21V 9/00*** | (2015.01) |
| ***F21V 29/00*** | (2015.01) |
| ***F21V 29/83*** | (2015.01) |
| *F21Y 101/02* | (2006.01) |

(52) U.S. Cl.

CPC ..... *F21V 29/2212* (2013.01); *F21S 4/28* (2016.01); *F21V 29/004* (2013.01); *F21V 29/83* (2015.01); *F21Y 2101/02* (2013.01)

(58) Field of Classification Search

CPC ... F21V 29/004; F21V 29/83; F21V 29/2212; F21S 4/28; F21Y 2101/02

USPC ..... 362/231, 238, 249.03, 249.14; 315/200 R, 201, 224, 246, 291, 302

See application file for complete search history.

(56) References Cited

U.S. PATENT DOCUMENTS

| | | | | |
|---|---|---|---|---|
| 3,432,726 | A | 3/1969 | Meyer et al. | |
| 5,871,274 | A | 2/1999 | Lee et al. | |
| 6,161,910 | A | 12/2000 | Reisenauer et al. | |
| 6,436,517 | B1 * | 8/2002 | Zahn | 428/209 |
| 2002/0059721 | A1 | 5/2002 | Crudo et al. | |
| 2003/0130379 | A1 * | 7/2003 | Panz et al. | 523/212 |
| 2003/0222282 | A1 | 12/2003 | Fjelstad et al. | |
| 2004/0095777 | A1 * | 5/2004 | Trenchard et al. | 362/477 |
| 2004/0119082 | A1 | 6/2004 | Sugawara | |
| 2004/0212318 | A1 | 10/2004 | Hamamoto et al. | |

(Continued)

FOREIGN PATENT DOCUMENTS

CN 201130491 Y 10/2008

*Primary Examiner* — Ali Alavi

(57) ABSTRACT

A lamp assembly (1800) may include a circuit board (201), one or more light-emitting devices (100) disposed on the circuit board (201), a heat sink (600) in thermal contact with a surface of the circuit board (201), a gasket (700) with a first surface in mechanical contact with the circuit board (201), a bezel (800) a surface (805) of which is in mechanical contact with a second surface of the gasket (700), and one or more fasteners (901) that may apply a force between the bezel (800) and the heat sink (600). A lamp array (2100) may include two or more lamp assemblies (1800), not all of which supply illumination with the same spectral characteristic, and a bearing mount (2000) that may support each lamp assembly (1800) and allow each to be oriented rotationally. A supply circuit (2500, 2600) may include a nonlinear resistive element (2501, 2601).

55 Claims, 27 Drawing Sheets

(56) References Cited

U.S. PATENT DOCUMENTS

| | | | | |
|---|---|---|---|---|
| 2004/0233671 | A1 | 11/2004 | Staufert | |
| 2005/0045897 | A1 | 3/2005 | Chou et al. | |
| 2005/0174065 | A1* | 8/2005 | Janning | 315/185 S |
| 2006/0171147 | A1 | 8/2006 | Day | |
| 2006/0187653 | A1 | 8/2006 | Olsson | |
| 2006/0255960 | A1* | 11/2006 | Uken et al. | 340/815.4 |
| 2006/0265921 | A1 | 11/2006 | Korall et al. | |
| 2007/0007898 | A1 | 1/2007 | Bruning | |
| 2008/0238649 | A1* | 10/2008 | Arszman et al. | 340/471 |
| 2009/0034255 | A1* | 2/2009 | Li | 362/249 |
| 2009/0059610 | A1 | 3/2009 | Marshall et al. | |
| 2009/0091914 | A1 | 4/2009 | Nobayashi | |

* cited by examiner

SECTION A-A

SECTION B-B

DETAIL A

SECTION A-A

SECTION A-A OF FIG. 9

VERSATILE SEALED LED LAMP

BACKGROUND

There exist multiple types of light sources currently in use for providing illumination. Such light sources are commonly referred to as lamps. Most of the lamps in use are electrically powered. One of the most common types in use is an incandescent lamp in which a filament of tungsten or other refractory material is heated by the power dissipated in the electrical resistance of the filament when an electrical current is forced through it. Usually, the electrical current is supplied to the filament directly from a power line providing a more or less constant average alternating-current voltage or from a power supply or battery operating at a more or less constant direct-current voltage. Incandescent lamps are designed to operate at voltages typically in the range between a few volts to 250 volts. Much of the dissipated power is radiated as heat in the form of infrared radiation, some of the power converts to heat that leaves the lamp through thermal conduction and convection, and a relatively small portion of the power is radiated as visible light. For an incandescent lamp the power efficiency of the lamp, which is calculated as the ratio of the power radiated as visible light to the total electrical power dissipated in the lamp, is typically about 5 percent or lower.

Another common type of lamp is a discharge lamp, in which electrical current flows through a gas. Excited by the current, the gas emits infrared, visible, and ultraviolet radiation. A fluorescent lamp is a type of discharge lamp in which much of the ultraviolet radiation is converted to visible radiation by a fluorescent coating. Other types of discharge lamps include sodium lamps, carbon arc lamps, mercury arc lamps, neon lamps, xenon lamps, and metal halide lamps. Visible light is radiated with power efficiencies ranging up to the low twenty percent range. Much of the remaining power is dissipated as infrared or ultraviolet radiation, and some may be converted to heat that is carried away through thermal conduction and convection.

Unlike incandescent lamps, discharge lamps generally require ballasts or controlled-current sources for stable operation. The operating voltage of a discharge lamp is frequently in the range of operating voltages of incandescent lamps, but the current through the lamp is much more sensitive to the voltage. Operation directly from an unregulated voltage supply such as a battery or an alternating-current power line may result in malfunction of the lamp due to large variations in current and, hence, power dissipation as the supply voltage varies.

A newer category of light sources distinct from incandescent lamps and discharge lamps is that of solid-state light-emitting devices. Included in this category are, for example, electroluminescent devices, semiconductor lasers, and light-emitting diodes. Unlike incandescent lamps and discharge lamps, solid-state light-emitting devices suitable for illumination emit substantially all of their radiation in the form of visible light, and the amount of power emitted in the form of infrared or ultraviolet radiation is relatively insignificant. Currently, the most efficient of these solid-state light-emitting devices, the light-emitting diodes (LEDs) and the semiconductor lasers, may operate at power efficiencies as high as twenty to forty percent. The electrical power that is not converted to light is converted to heat. Due to the small sizes of practical high-power devices, usually only a small fraction of the heat is removed through convection, and the remainder of the heat is removed through thermal conduction. Relative to incandescent lamps and discharge lamps in general, the efficiency and reliability of solid-state light-emitting devices are more sensitive to temperature. The efficiency drops significantly at high operating temperatures, and the rate at which the light output degrades over time increases by a factor of typically between two and ten for every 10° C. rise in temperature. A heat sink and a thermally conductive path between the light-emitting device and the heat sink are generally provided in order to limit the rise in temperature of the light-emitting device due to the heat generated within it. For example, LEDs are frequently furnished by the manufacturer as surface-mount assemblies that may be soldered to conductors on the top surface of a thin electrically insulating circuit board backed by a sheet of thermally conductive metal such as aluminum or copper. Metalized conductive vias in the insulating circuit board may assist in conducting heat from the conductors on the top to the metal sheet on the back.

The most efficient solid-state light-emitting devices, the LEDs and semiconductor lasers, are generally limited by practical considerations to input power levels of a few watts or lower per device. Each device runs at a voltage typically between two and four volts. For applications such as wide-area illumination that require input power levels of tens to hundreds of watts, it is common practice to include multiple light-emitting devices in an assembly and to electrically connect the multiple light-emitting devices in series. Given a fixed operating current and temperature, the total light output of such a series-connected assembly and the voltage across the assembly are both proportional to the number of light-emitting devices in the assembly.

Most incandescent lamps and discharge lamps are hermetically sealed, since they require the maintenance of a partial vacuum, but solid-state light-emitting devices typically are not hermetically sealed. As a result, special considerations may apply regarding the protection from the environment of an assembly of LEDs or semiconductor lasers and the conductors that interconnect them and carry electrical power to them. In particular, liquids coming into contact with the conductors or the light-emitting devices, especially while electrical power is applied, can result in electrolytic corrosion of the conductors or of the light-emitting devices leading to premature failure of the assembly. Human contact with the conductors or with liquids in contact with the conductors can result in electrical shock. Mechanical stress on one or more conductors, wires, or cables exiting the assembly may result in damage to the assembly, if the conductors, wires, or cables are not sufficiently secured mechanically to the assembly.

If portions of a lamp assembly employing light-emitting devices should intercept and cause to be absorbed some of the light emitted by the light-emitting devices, the photonic power efficiency of the lamp assembly may be reduced. This fact is a consideration influencing the design of various portions of the assembly including any that provide environmental protection or that contribute to the mechanical or electrical connections within the assembly.

High-power light-emitting devices suitable for use in illumination applications can be bright enough to cause eye damage in some circumstances. For some applications eye safety may be a consideration in the design of a lamp assembly.

Unlike incandescent lamps and discharge lamps, which may radiate light in almost all directions, solid-state light-emitting devices usually radiate in some directions but not others. An LED, for example, typically radiates with a Lambertian pattern into the space on one side of a plane. Special considerations may apply, therefore, to the way light-emitting devices are oriented within an assembly or the way an assembly is oriented while the assembly is being applied to provide illumination.

Each solid-state light-emitting device has its own spectral characteristic, which is defined by the distribution of power of the light emitted over the wavelength of the light emitted. For some the spectral characteristics show distributions in which most of the emitted power is confined to a narrow wavelength range. The light from these devices has a highly saturated color, the color depending on the dominant wavelength. Other devices may emit light that is less saturated in color or that is white. These devices have spectral characteristics with broader distributions over wavelength. No one solid-state light-emitting device has yet been devised that has a spectral characteristic broad enough to match that of the sun. When a broad spectral characteristic is desired, the light from multiple light-emitting devices of different spectral characteristics or colors is frequently combined. In applying solid-state light-emitting devices in illumination applications it is generally the practice to blend the light from these multiple devices in a way that prevents observers from perceiving the separate colors of the devices. The light from this source consisting of multiple light-emitting devices of different colors then appears as light of a single uniform spectral characteristic or color.

As is the case for discharge lamps, the electrical current drawn by solid-state light-emitting devices is usually so sensitive to the voltage across them that some form of ballast or current limiting in the power supply is desirable to prevent excessive variations in the power supplied to the devices as a result of normal variations in voltage on the power source. This problem exists with series-connected devices to the same extent that it does with individual devices. Common practices include the use of a resistor electrically in series with the light-emitting devices, use of a ballast inductor in series with an alternating current source supplying power to the light-emitting devices, or use of a switching-mode power converter to drive the light-emitting devices with a regulated current.

BRIEF SUMMARY

In some examples, a lamp assembly may include a circuit board, one or more light-emitting devices, a heat sink, a gasket, a bezel, and one or more fasteners. The circuit board may have an electrically insulating layer of material, a thermally conductive backing layer, and one or more electrically conductive traces disposed on a first major surface of the electrically insulating layer of material, an opposing surface of which may be in thermal contact with a surface of the thermally conductive backing layer. The one or more light-emitting devices may be disposed on the circuit board, in thermal contact with the circuit board, and in electrical contact with at least one of the electrically conductive traces. The heat sink may be composed of thermally conductive material a surface of which is in thermal contact with the thermally conductive backing layer. The gasket may have a first surface and an opposing second surface, the first surface being in mechanical contact with a surface of the circuit board. The bezel may have a surface that is in mechanical contact with the second surface of the gasket. The one or more fasteners may be configured to apply force between the bezel and the heat sink resulting in the application of pressure between the bezel and the gasket, between the gasket and the circuit board, and between the circuit board and the heat sink.

In some examples, a lamp array may include two or more lamp assemblies, one of which supplies illumination with a first spectral characteristic and another of which supplies illumination with a second spectral characteristic different from the first spectral characteristic, and each of which may include two or more light-emitting devices. The lamp array may also include a bearing mount having one or more bearings supporting each lamp assembly in a manner that allows each lamp assembly to be individually oriented rotationally about an axis of rotation. In further examples, the light-emitting devices in each lamp assembly of a lamp array may be arranged in a line having a direction. The lamp assemblies may be positioned such that the direction of the line is substantially the same for all of the lamp assemblies. The lamp assemblies may, in addition, be positioned in two or more rows in each of which the lines in which the light-emitting devices are arranged in the lamp assemblies are collinear and in which every lamp assembly in the same row supplies illumination with the same spectral characteristic, which spectral characteristic is not the same for every row.

In some examples, a supply circuit may include an output terminal for providing current to a load; a drive voltage terminal for receiving an electromotive force for driving current through the load; and a nonlinear resistive element with a first terminal electrically connected to the drive voltage terminal and a second terminal electrically connected to the output terminal, the nonlinear resistive element having a dynamic electrical resistance that varies with the magnitude of the electrical current through the nonlinear resistive element, the resistance tending to rise when the magnitude of the electrical current rises and to fall when the magnitude of the electrical current falls. In further examples, the nonlinear resistive element may include a filament that is heated by electrical current flowing through the filament, and the filament may have a dynamic electrical resistance that increases as the filament rises in temperature. In further examples, the nonlinear resistive element may be an incandescent lamp.

In some examples, a supply circuit may include an output terminal for providing current to a load, a drive voltage terminal for receiving the electromotive force for driving current through the load, a surge-limiting circuit having a first terminal electrically connected to the drive voltage terminal and a second terminal electrically connected to the output terminal; a first alternating-current power terminal for providing alternating current to a circuit; a second alternating-current power terminal for returning alternating current from a circuit; a rectifier with a first alternating-current input terminal electrically connected to the first alternating-current power terminal, a second alternating-current input terminal electrically connected to the second alternating-current power terminal, a first direct-current output terminal electrically connected to the drive voltage terminal, and a second direct-current output terminal electrically connected to the common terminal; a line input terminal for obtaining power from a power line; and a current-impeding circuit having one terminal electrically connected to the line input terminal and another terminal electrically connected to the first alternating-current power terminal. The surge-limiting circuit may be one that is capable of limiting the magnitudes of current surges that may result from temporary excesses in electromotive force between the drive voltage terminal and the common terminal. The current-impeding circuit may be one that is capable of limiting the magnitudes of current surges that may result from surges in the electric potential between the line input terminal and the second alternating-current power terminal, and may include a nonlinear resistive element having a dynamic electrical resistance that varies with the magnitude of the electrical current through the nonlinear resistive element, the resistance tending to rise when the magnitude of the electrical current rises and to fall when the magnitude of the electrical current falls. The current-impeding circuit may be one that causes to flow through the nonlinear resistive element most of the electrical current that flows through the current-impeding circuit from the line input terminal and the first alternating-current power terminal. In further examples, the nonlinear resistive element may include a filament that is heated by electrical current flowing through the filament, and the filament may have a dynamic electrical resistance that increases as the filament rises in temperature. In further examples, the nonlinear resistive element may be an incandescent lamp.

DETAILED DESCRIPTION OF VARIOUS EMBODIMENTS

A versatile sealed LED lamp assembly disclosed in the present application will become better understood through review of the following detailed description in conjunction with the drawings. The detailed description and drawings provide examples of the various embodiments described herein. Those skilled in the art will understand that the disclosed examples may be varied, modified, and altered without departing from the scope of the disclosed structures. Many variations are contemplated for different applications and design considerations; however, for the sake of brevity, not every contemplated variation is individually described in the following detailed description.

An embodiment of an LED lamp assembly is now described in more detail with reference to FIGS. 1-27. In the various figures, like or similar features have the same reference labels. Each figure may include one or more views of objects. All views described as "top view" show objects as viewed from a particular direction with all objects oriented as they would be in an overall assembly shown in FIG. 21B. Descriptors such as "top" or "bottom" are relative references that aid in the description and are not intended to indicate a particular position or orientation.

Figure 1A:
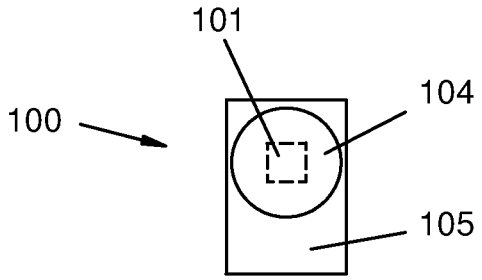
FIG. 1A (PRIOR ART)
FIGS. 1A, 1B, and 1C show a top view, an end view, and a bottom view respectively of a typical LED showing various elements that the LED may include.

FIG. 1 illustrates an example of an LED 100. LED 100 may include an LED chip 101, which may emit light when excited by an electrical current. LED 100 may also include two or more electrical connection points 102 that allow electrical connection to LED 100 for the purpose of exciting LED chip 101 and may include one or more thermal pads 103 from which heat may be efficiently extracted from LED 100. LED 100 may additionally include a lens 104 for assisting in the extraction of light from LED chip 101, protecting LED chip 101 against environmental influences, stabilizing electrical or mechanical connections to LED chip 101, distributing heat, and/or shaping the pattern of light emission. LED 100 may also include an LED substrate 105 that may serve to fix the position of LED chip 101 in relation to electrical connection points 102 and/or thermal pad 103 and/or lens 104 or that may serve to assist in the extraction of heat from LED chip 101.

Figure 1B:
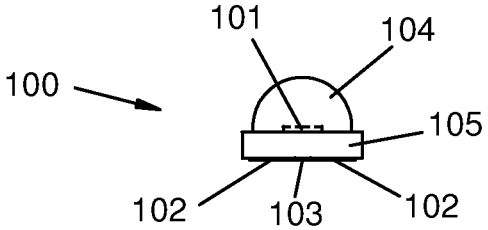
FIG. 1B (PRIOR ART)
Figure 1C:
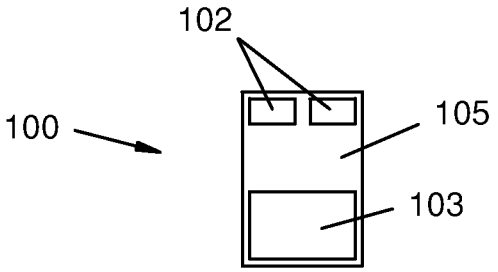
FIG. 1C (PRIOR ART)

One or more of the electrical connection points 102 may consist of electrically conductive pads on the same surface of LED 100 as thermal pad 103, as shown in FIGS. 1B and 1C. Alternatively, an electrical connection point 102 may be an end of a bond wire or other electrically conducting element electrically connected to a portion of LED 100 on a surface other than the surface on which thermal pad 103 is situated. For example, in a chip-on-board configuration bond wires may be bonded from the top of LED chip 101 to connection points on the same plane as that of the bottom side of LED chip 101.

A thermal pad 103 may also act as an electrical connection point 102. In addition, two or more electrical connection points 102 may act as thermal pads 103.

An LED chip 101 may be in the form of a single die or an array of two or more dice. A lens 104 may consist of a single element or multiple elements. For example, lens 104 may include an element on each die of an array of dice.

Figure 2:
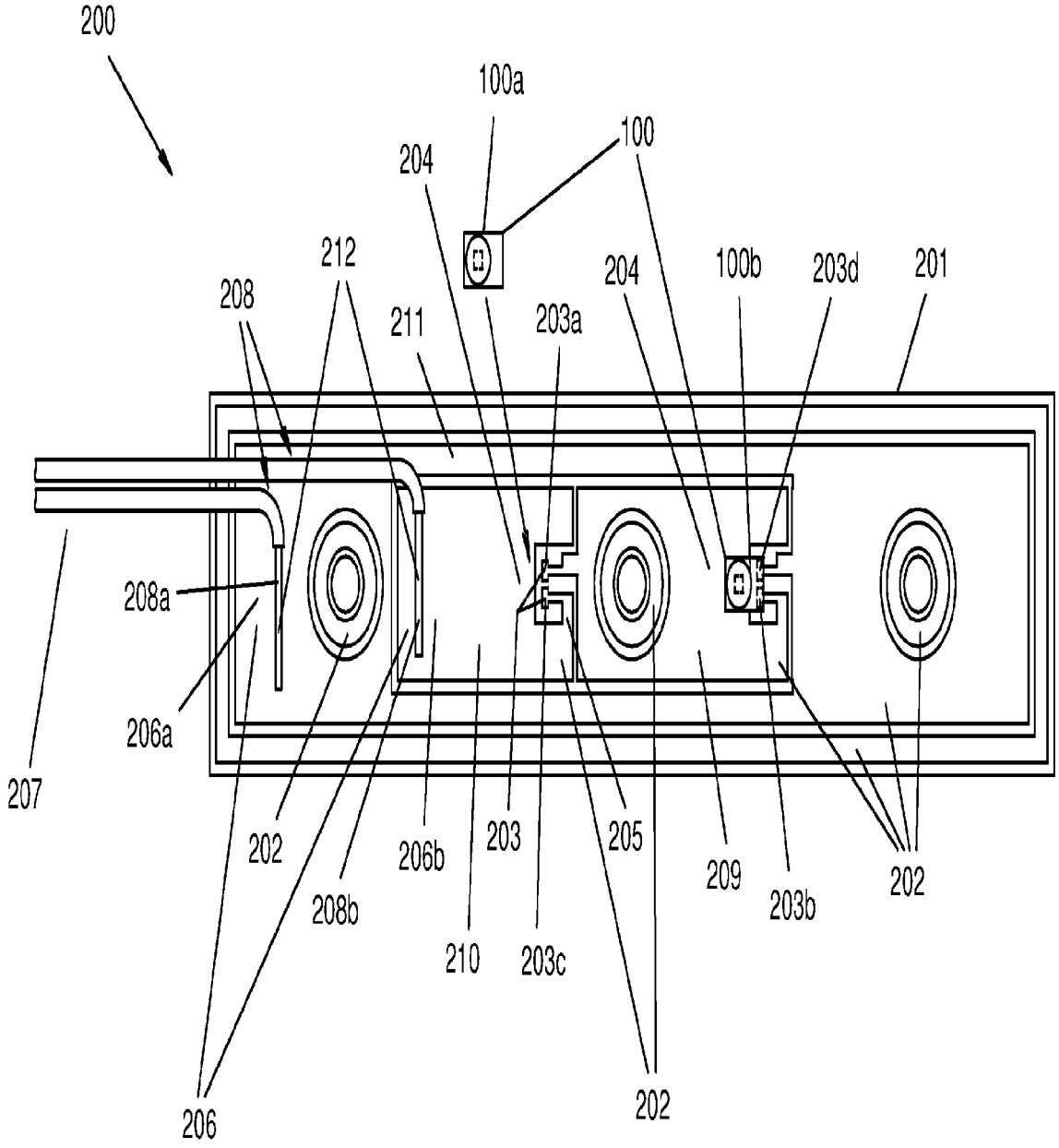
FIG. 2 is a top view of an example of a circuit board assembly including a circuit board, two LEDs being assembled onto the circuit board, and a cable connected to the circuit board.

FIG. 2 illustrates an example of a circuit board assembly 200 including a circuit board 201 and one or more LEDs 100 being assembled thereto. Disposed on circuit board 201 may be a patterned conducting layer 202 that may include electrical connection pads 203 and at least one thermal connection pad 204. The connection pads 203 and 204 may be positioned such that an electrical connection point 102 on LED 100 may be placed on or adjacent to an electrical connection pad 203 on circuit board 201 while a thermal pad 103 on LED 100 is simultaneously positioned on or adjacent to a thermal connection pad 204 on circuit board 201. The positioning may be such that electrical connection may be made between electrical connection point 102 and electrical connection pad 203 and a thermal connection may be made between thermal pad 103 and thermal connection pad 204. These connections may be facilitated through the use of solder, pressure, conductive elastomeric gaskets, conductive epoxy, or other means for achieving electrical and/or thermal connections. In a preferred embodiment LED 100 is a surface-mount component, and the electrical and thermal connections are accomplished with solder as is commonly practiced in the art of surface-mount technology.

Thermal connection pad 204 on circuit board assembly 200 may extend over an area of circuit board 201 larger than the area of thermal pad 103 and may be composed of a material such as copper or aluminum that has high thermal conductivity, so that heat from thermal pad 103 on LED 100 may be spread out over a comparatively large area on circuit board 201. Thermal connection pad 204 may be electrically connected through portion 205 of patterned conducting layer 202 to an electrical connection pad 203, as shown in FIG. 2. Alternatively, thermal connection pad 204 may be electrically isolated, or it may be connected to an electrical ground or to an electrical node other than an electrical connection pad 203.

Patterned conducting layer 202 on printed circuit 201 may include terminals 206 for electrically connecting the circuitry on circuit board 201 to a cable 207. Individual wires 208 from cable 207 may be soldered or otherwise electrically connected to terminals 206. FIG. 2 shows, for example, two wires 208*a* and 208*b* from cable 207 soldered to terminals 206*a* and 206*b* respectively of circuit board 201.

Figure 3:
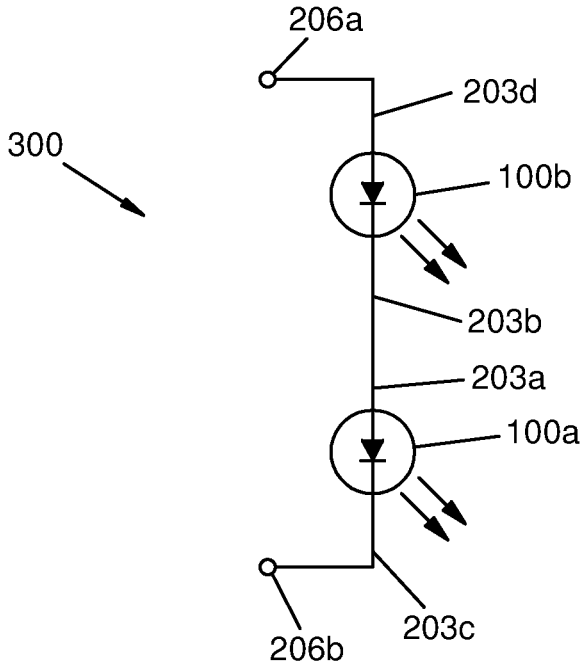
FIG. 3 is an example of a circuit diagram for the series-connected LEDs on the circuit board of FIG. 2.

Patterned conducting layer 202 may provide electrical connections between LEDs and between LEDs and terminals. For example, in FIG. 2 patterned conducting layer 202 is configured for connecting LEDs 100*a* and 100*b* in series. Conductor 209, which is a portion of patterned conducting layer 202, electrically connects electrical connection pad 203*a* for LED 100*a* to electrical connection pad 203*b* for LED 100*b*. Also, as shown in FIG. 2 conductor 210, which is another portion of patterned conducting layer 202, electrically connects electrical connection pad 203*c* for LED 100*a* to terminal 206*b* on circuit board 201; and conductor 211, which is yet another portion of patterned conducting layer 202, electrically connects electrical connection pad 203*d* under LED 100*b* to terminal 206*a* on circuit board 201. The resulting circuit is as shown in the schematic diagram 300 in FIG. 3. In FIG. 3 the electrical nodes corresponding to electrical connection pads 203*a*, 203*b*, 203*c*, and 203*d*, and to terminals 206*a* and 206*b* are indicated.

The connection of LEDs 100 in FIG. 3 is a series connection. As is well known in the art, suitable changes to the patterning of patterned conducting layer 202 may be made to accomplish other connection schemes including without limitation parallel connections of LEDs, series-parallel connections of LEDs, and connections involving additional components such as resistors, fuses, incandescent lamps, transistors, and regulators.

Figure 4A:
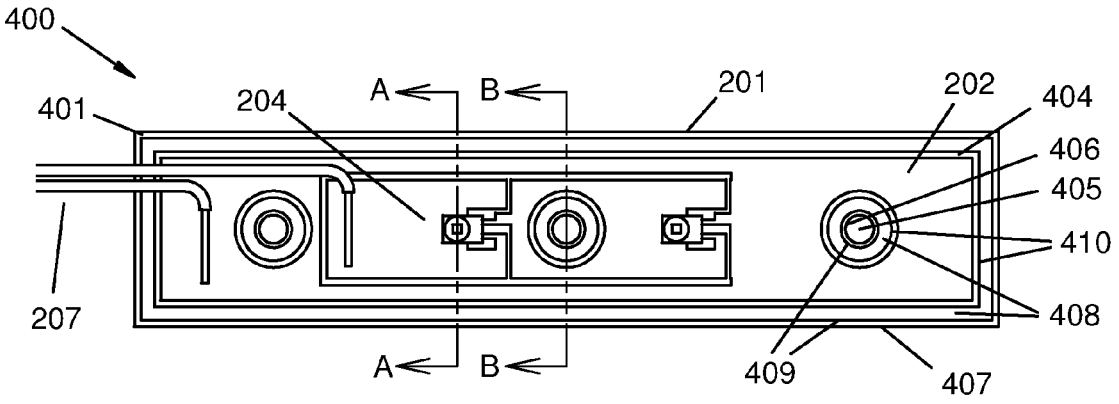
FIG. 4A is a top view of the circuit board assembly of FIG. 2
Figure 4B:
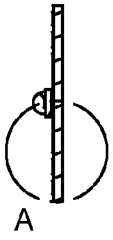
FIGS. 4B and 4C show cross sections A-A and B-B respectively of the circuit board assembly as indicated in FIG. 4A.
Figure 4C:
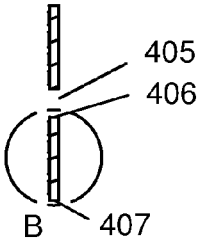
Figure 4D:
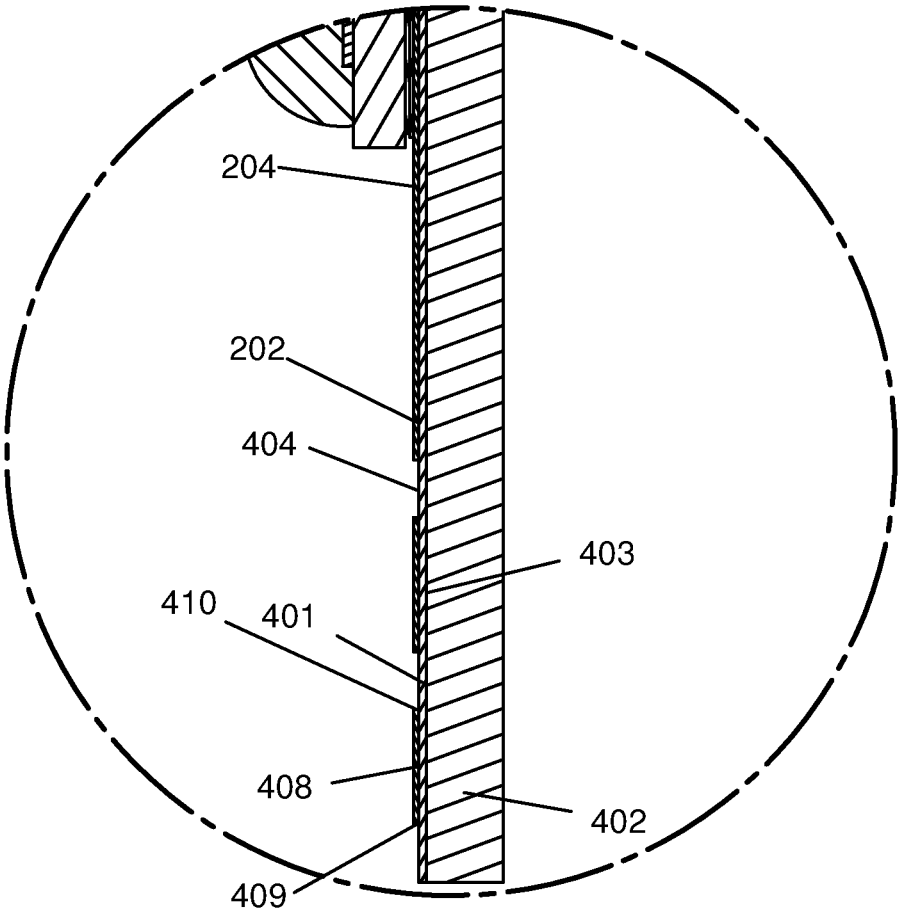
FIG. 4D shows details of the portion of cross section A-A enclosed by circle A in FIG. 4B.
Figure 4E:
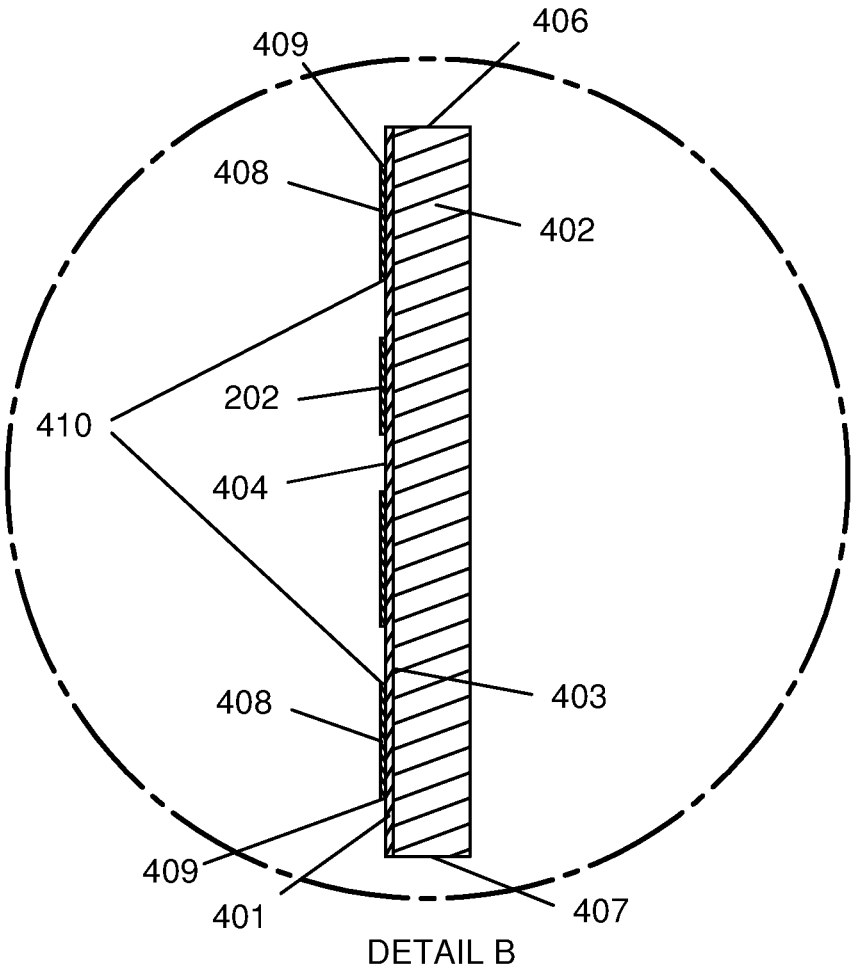
FIG. 4E shows details of the portion of cross section B-B enclosed by circle B in FIG. 4C.

FIGS. 4A, 4B, and 4C show a top view and two cross-sectional views of an exemplary circuit board assembly 400 consisting of circuit board 201 of FIG. 2 with LEDs 100 attached and with cable 207 connected. As depicted in cross section A-A and cross section B-B, details of portions of which are shown in FIGS. 4D and 4E respectively, circuit board 201 may include an electrically insulating layer 401 and may also include a backing layer 402 adjacent to the back surface 403 of electrically insulating layer 401. Patterned conducting layer 202 may be supported on the front surface 404 of electrically insulating layer 401. Electrically insulating layer 401 may be electrically insulating to the extent necessary to provide sufficient insulation between disconnected portions of patterned conducting layer 202 and between these portions and any conducting material, such as a backing layer 402, touching back surface 403. Electrically insulating layer 401 may be thermally conductive and may be in intimate thermal contact with patterned conducting layer 202 and backing layer 402, so that heat may be conducted freely from a thermal connection pad 204 to backing layer 402. In addition, electrically insulating layer 401 may be perforated with one or more vias (not shown) that may be metalized or may be filled partially or completely with thermally conductive material to enhance the conduction of heat from patterned conducting layer 202 to backing layer 402.

As shown in the FIG. 4A and in section B-B as depicted in FIGS. 4C and 4E, circuit board 201 may have mounting holes 405 extending through electrically insulating layer 401 and backing layer 402. Associated with mounting holes 405 are inner edges 406. Circuit board 201 may also have an outer edge 407. Disposed along outer edge 407 and along each of some or all of the inner edges 406 may be portions of patterned conducting layer 202 forming sealing rings 408. Each sealing ring 408 may be a continuous strip running substantially parallel to the adjacent inner edge 406 or outer edge 407. Each sealing ring 408 may have one outer side 409 closest to the adjacent inner edge 406 or outer edge 407 and one inner side 410 farthest from the adjacent inner edge 406 or outer edge 407. Each sealing ring 408 may be either electrically connected to or electrically isolated from other portions of patterned conducting layer 202. The outer side 409 of sealing ring 408 may be either separated from or coincident with the adjacent inner edge 406 or outer edge 407. In a preferred embodiment each sealing ring 408 may have a width between its outer side 409 and its inner side 410 of approximately 0.060 inches, and its outer side 409 may be spaced approximately 0.020 to 0.030 inches from the adjacent inner edge 406 or outer edge 407. In this preferred embodiment each sealing ring 408 may be electrically isolated from and spaced at least approximately 0.030 inches from any other portion of patterned conducting layer 202.

The sealing rings 408 may provide a raised flat surface against which an elastomer or an adhesive may form a watertight seal. The spacings between the outer sides 409 of sealing rings 408 and the edges 406 and 407 may reduce the possibility of electrical shorting between sealing rings 408 and other conductive materials such as backing layer 402 and may thereby reduce the likelihood of occurrence of electrolytic corrosion in the presence of water. The spacings between the inner sides 410 of sealing rings 408 and other portions of patterned conducting layer 202 may reduce the possibility of electrical shorting or leakage between sealing rings 408 and portions of patterned conducting layer 202 that may be supporting significant electrical potentials. These spacings may therefore reduce an electric shock hazard and may reduce the likelihood of electrolytic corrosion.

In a preferred embodiment of circuit board 201 the patterned conducting layer 202 consists of copper metal with a thickness of approximately 0.0014 inches, the insulating layer 401 consists of an epoxy-based composite material approximately 100 micrometers thick having a thermal conductivity of approximately 2 watt/meter-kelvin, and a backing layer 402 consists of 6061-T6 aluminum approximately 1 millimeter thick.

As is common in circuit board manufacture circuit board 201 may be covered with a soldermask layer (not shown) with openings over certain portions of circuit board 201 such as at electrical connection pads 203, thermal connection pads 204, and terminals 206. In some embodiments the soldermask may be omitted over sealing rings 408 or may be omitted altogether. The soldermask layer may be composed of a material that is reflective of light at the wavelengths to be emitted by the LEDs 100.

Figure 5:
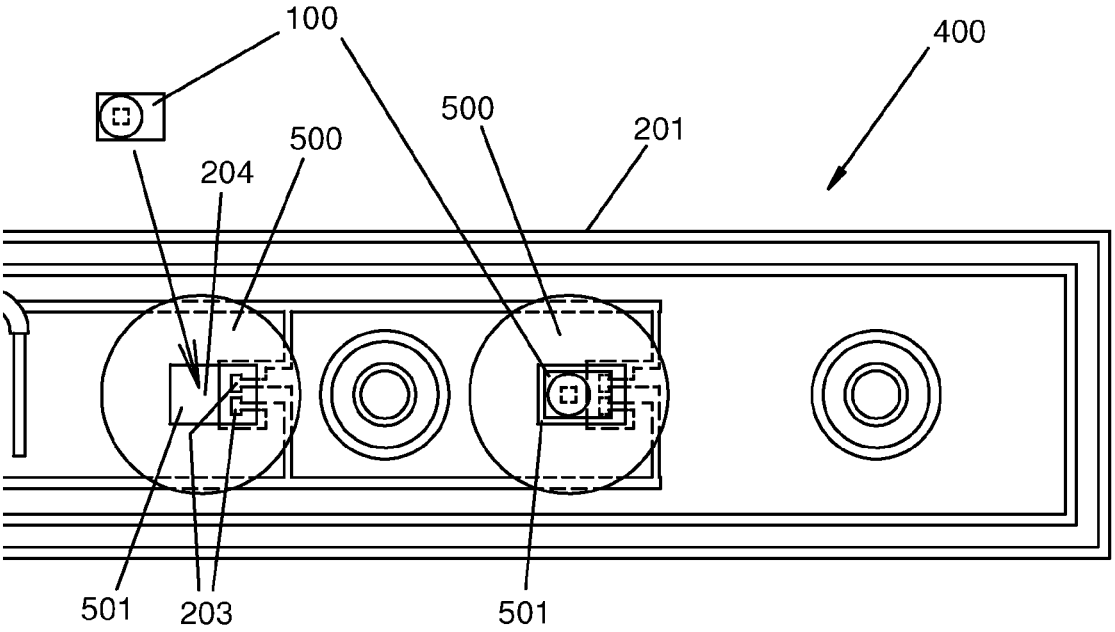
FIG. 5 is a top view of a portion of the circuit board assembly of FIG. 2 including silkscreened areas around the LED locations.

As is also common in circuit board manufacture circuit board 201 may include a silkscreen layer. A silkscreen layer is typically an ink layer used for creating labels. In a preferred embodiment the silkscreen layer may also be used to create a light-reflecting background 500 around each LED 100 on circuit board assembly 400, as shown in FIG. 5. For this purpose the silkscreen ink is preferably white or otherwise highly reflective at the light wavelengths to be emitted by the LEDs 100. The silkscreen ink may be applied on top of all other layers on circuit board 201. Light-reflecting background 500 may be shaped to cover most areas of the circuit board 201 that will be exposed directly or through reflection to light from LED 100. The ink may be omitted from attachment areas 501 that may include one or more electrical connection pads 203 or thermal connection pads 204.

Figure 6A:
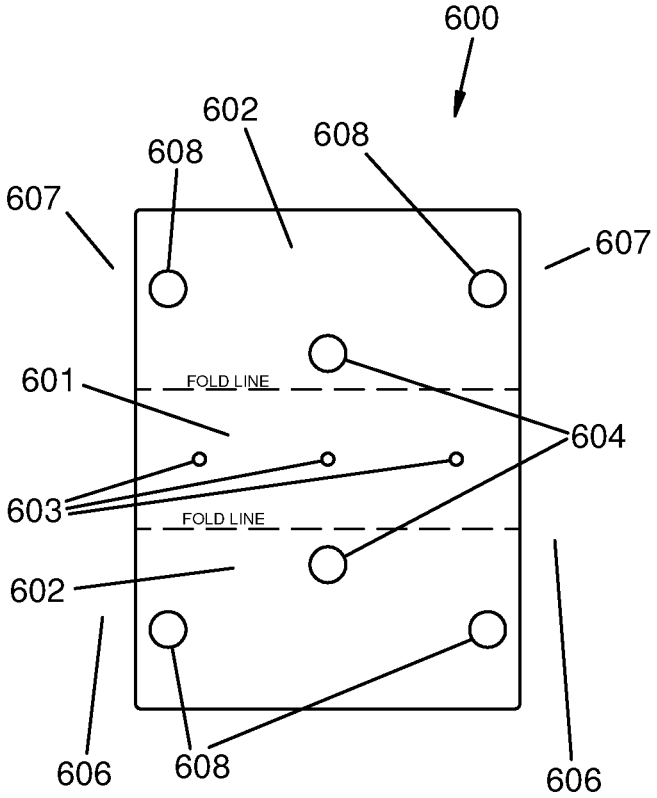
FIG. 6A is a drawing of an example of a sheet-metal heat sink with the sheet unfolded.
Figure 6B:
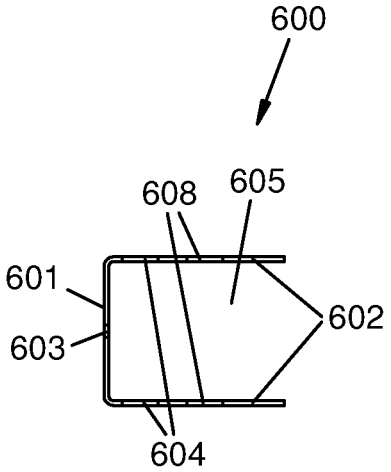
FIG. 6B is a drawing of the sheet-metal heat sink of FIG. 6A with the sheet folded.

FIGS. 6A and 6B show the construction of a preferred embodiment of a heat sink 600. FIG. 6A shows a plan view of sheet material before it is formed. FIG. 6B shows an end view of the same sheet material after it has been formed through a procedure that folds the material at the fold lines indicated in FIG. 6A. Heat sink 600 may be formed of sheet metal as shown, or it may be fabricated by extrusion, injection molding, casting, machining, electroforming, or other methods. The material may be highly thermally conductive. Heat sink 600 may have a mounting area 601 and may have one or more fins 602. There may be one or more heat sink mounting holes 603 penetrating mounting area 601. There may be one or more ventilation holes 604 penetrating mounting area 601 or fins 602 or both. Ventilation holes 604 may enhance air flow into or out of semi-enclosed spaces, such as space 605, which is partially enclosed by heat sink 600. Portions of fins 602 may be louvered, perforated, expanded, or otherwise increased in surface area or extent for the purpose of enhancing convective heat flow from heat sink 600 to the surrounding atmosphere. Near one or both ends 606 of heat sink 600 may be placed attachment structures 607 such as attachment holes 608 the purpose of which is to facilitate the attachment of other parts to heat sink 600. Louvers, bumps, indentations, or other structures for facilitating attachment of parts may substitute for some or all of the attachment holes 608.

The mounting area 601 may be sized and shaped to accommodate circuit board 201, and the heat sink mounting holes 603 may have positions matching the positions of mounting holes 405 in circuit board 201.

In a preferred embodiment heat sink 600 may be fabricated from 5052 aluminum sheet approximately 0.050 inches thick.

Figure 7:
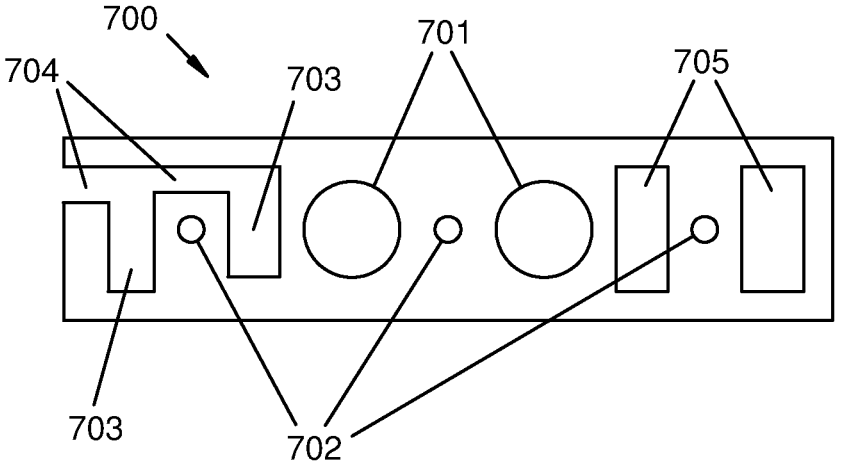
FIG. 7 is a top view of an example of a gasket showing various cutouts in the sheet material.

FIG. 7 is a drawing of an exemplary gasket 700. Gasket 700 may have a size roughly similar to that of circuit board 201. Gasket 700 may have apertures 701 with positions corresponding to the positions of LEDs on circuit board assembly 400. Gasket 700 may also have fastener clearance holes 702 with positions corresponding to the positions of mounting holes 405 in circuit board 201. Gasket 700 may also have connection clearance holes 703 with positions corresponding to the positions of terminals 206 on circuit board 201, and gasket 700 may have one or more gaps 704 to make room for wires, cables, or connector leads attached to terminals 206. Gasket 700 may have additional holes 705 for various purposes such as reducing the amount of gasket area that may be subject to compressive forces, reducing the weight of the gasket, or reducing the materials cost.

In a preferred embodiment gasket 700 consists of a flat sheet of silicone rubber white in color and 0.045 inches thick. A blank sheet may be punched to form the holes and the edges, or the patterned sheet may be fabricated through molding or other methods.

Figure 8A:
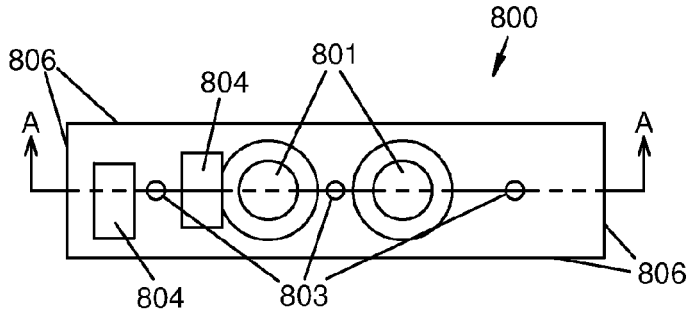
FIGS. 8A, 8B, and 8C show a top view, an end view, and a cross-sectional view respectively of an example of a bezel. The cross section shown in FIG. 8C is in the plane A-A of FIG. 8A.
Figure 8B:
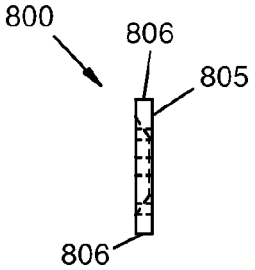
Figure 8C:
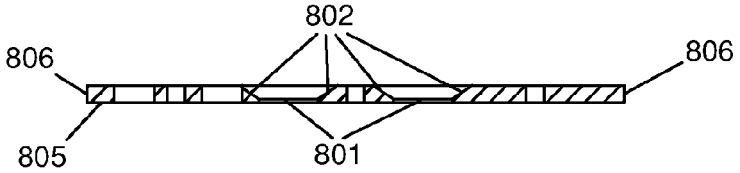

FIGS. 8A and 8B show a top view and an end view respectively of an exemplary bezel 800, and FIG. 8C shows a cross section in the plane A-A indicated in FIG. 8A. Bezel 800 may have roughly the same outline size and shape as gasket 700. Bezel 800 may have light windows 801 corresponding in position to the apertures 701 in gasket 700. Light windows 801 may have beveled edges 802. Bezel 800 may also have bezel mounting holes 803, which may correspond in position to the fastener clearance holes 702 in gasket 700 or the mounting holes 405 in circuit board 201. In addition bezel 800 may have terminal windows 804, which may correspond in position to the connection clearance holes 703 in gasket 700 or the terminals 206 on circuit board 201. In some embodiments bezel 800 may also have indentations or grooves (not shown) on the bezel back side surface 805 in positions corresponding to the positions of gaps 704 in gasket 700. Edges 806 of bezel 800 may be shaped or beveled for artistic effect.

In a preferred embodiment bezel 800 may be fabricated from 6061-T6 sheet aluminum and may be approximately 0.125 inches thick.

Figure 9:
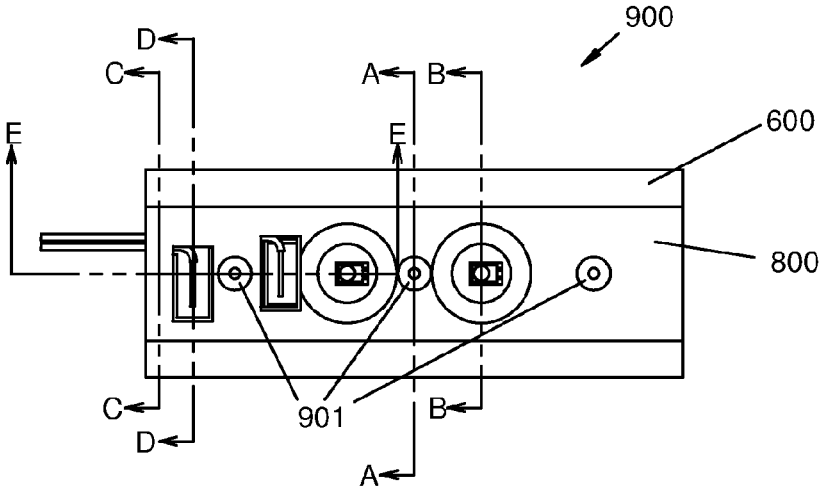
FIG. 9 is a top view of an exemplary lamp subassembly including a heat sink, a circuit board assembly, a gasket, a bezel, a cable, fasteners, and potting material. The positions and orientations of five different cross sections of the subassembly are indicated.
Figure 10A:
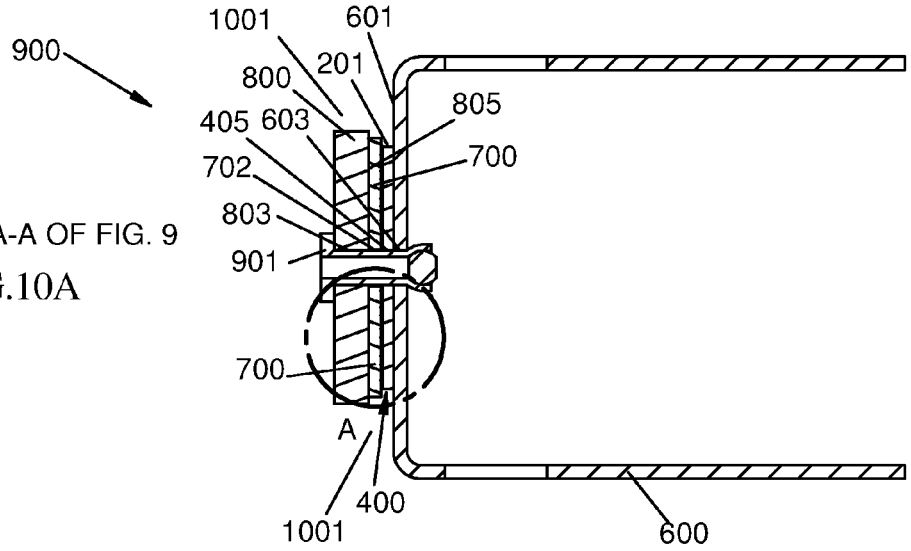
FIG. 10A is a cross-sectional view of the lamp subassembly in the plane A-A of FIG. 9. The placements of various components of the subassembly including a fastener are shown.
Figure 10B:
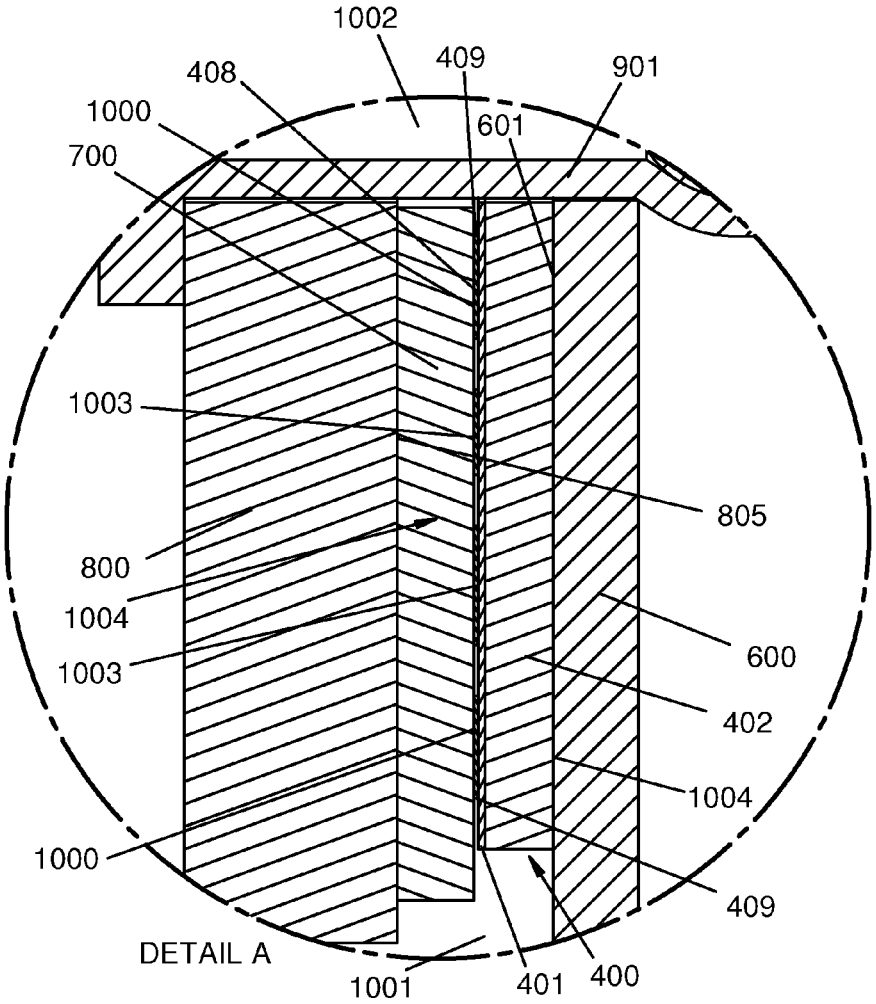
FIG. 10B shows details of the portion of cross section A-A enclosed by circle A in FIG. 10A.

FIG. 9 shows a top view and indicates the positions of some cross-sectional views of a lamp subassembly 900. FIG. 10A shows cross section A-A of FIG. 9, and FIG. 10B shows details of the portion of cross section A-A enclosed by circle A in FIG. 10A. The cross section is shown on its side with the "top" toward the left. As shown in FIGS. 9, 10A and 10B, heat sink 600 may be the base of the assembly. Circuit board assembly 400 may be placed on top of mounting area 601 of heat sink 600 in such a way that the back side 1004 of backing layer 402 may be flush against the surface of heat sink 600 over the mounting area 601 and that the mounting holes 405 in circuit board 201 may be concentric with heat sink mounting holes 603. In some embodiments there may be a thin elastomer, epoxy, thermal grease, or other medium (not shown) between the surface of heat sink 600 and back side 1004 of backing layer 402 to facilitate the transfer of heat from circuit board assembly 400 to heat sink 600.

Further, as shown in FIGS. 10A and 10B, gasket 700 may be placed on top of circuit board assembly 400 in such a way that a broad surface of gasket 700 may overlie sealing rings 408 and that fastener clearance holes 702 in gasket 700 may be concentric with mounting holes 405 in circuit board 201. Next, bezel 800 may be placed over gasket 700 in such a way that bezel back side surface 805 may contact gasket 700 in areas overlying sealing rings 408 and that bezel mounting holes 803 may be concentric with heat sink mounting holes 603.

For the purpose of binding all of the parts together with a compressive force, fasteners 901 may be inserted through the mounting holes, including bezel mounting holes 803, fastener clearance holes 702, mounting holes 405, and heat sink mounting holes 603, as shown in FIG. 10A, and then may be tightened to apply compressive force. Fasteners 901 may be pop rivets, as shown in the figures, or they may be screws and nuts or other fastener types. As seen in FIGS. 10A and 10B the compressive force may result in a seal 1000 that may prevent liquids and other contaminants from intruding from the assembly outer edges 1001 and assembly inner edges 1002 to the portions 1003 of patterned conducting layer 202 within the protected space 1004 bounded by sealing rings 408, electrically insulating layer 401, and gasket 700. In addition, seal 1000 may prevent contact of persons or animals with high-voltage conductors on circuit board 201 or with liquids that might, without seal 1000, come into contact with such high-voltage conductors. In a preferred embodiment sealing rings 408 may be insulated from other conductors and left floating in electrical potential so that little or no current may flow from outer sides 409 of sealing rings 408 to other conducting elements, such as heat sink 600, bezel 800, persons, or animals. In addition, in a preferred embodiment sealing rings 408 including outer sides 409 may be covered with electrically insulating soldermask coating (not shown) to further prevent liquid contact with sealing rings 408.

Figure 11A:
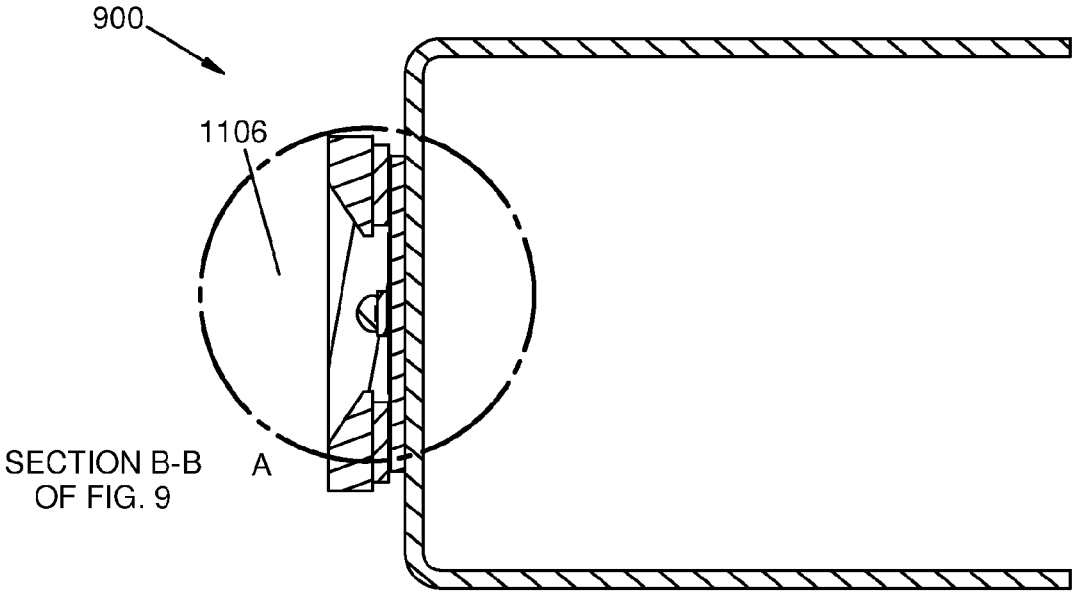
FIG. 11A is a cross-sectional view of the lamp subassembly in the plane B-B of FIG. 9. The cross section includes an LED and potting material.
Figure 11B:
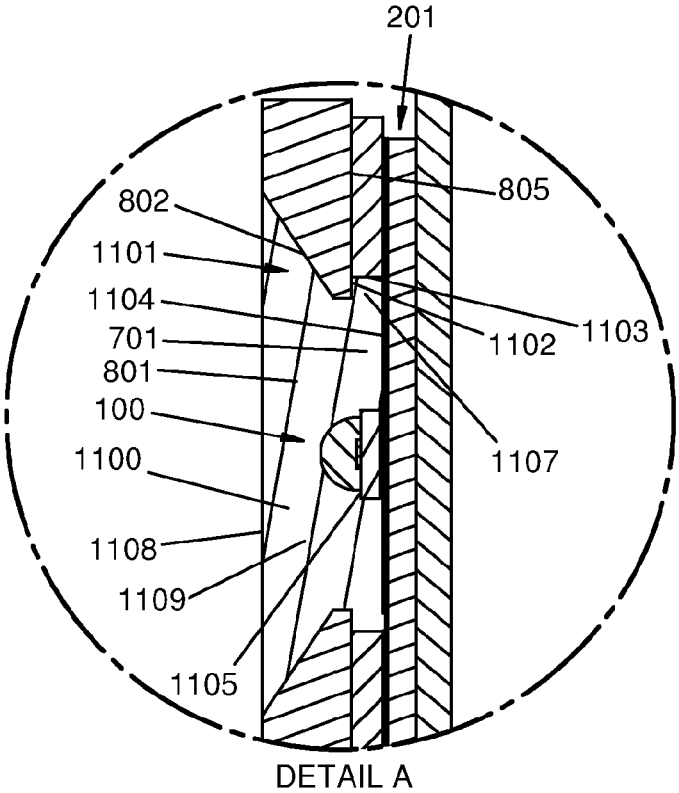
FIG. 11B shows details of the portion of cross section B-B enclosed by circle A in FIG. 11A.

FIG. 11A, which shows cross section B-B of FIG. 9, and FIG. 11B, which shows details of the portion of cross section B-B enclosed by circle A in FIG. 11A, reveal how each LED may be sealed. The space around LED 100 may be substantially filled with a potting compound 1100, which may bind to surfaces that may include edges 1101 of light window 801 including beveled edges 802, and/or a portion 1102 of bezel back side surface 805, edges 1103 of gasket apertures 701, a portion 1104 of the surface of circuit board 201, and the exposed surface 1105 of LED 100. Potting compound 1100 may thus serve to block the potential ingress of liquids and other contaminants from the outside 1106 of lamp subassembly 900. Circuit board 201 and LED 100 may thus be protected from the corrosive influences of liquids and electrolysis, from poisoning by contaminants, and from electrical shorting or optical degradation by dust. In addition, persons or animals may thus be protected from contact with high-voltage conductors that may be situated on circuit board 201 or LED 100 and from contact with liquids that may be in contact with such high-voltage conductors.

In a preferred embodiment bezel back side surface 805 may extend beyond the edge 1103 of gasket aperture 701 creating an overhung region 1107, as shown in FIG. 11B. Being filled with potting compound 1100, overhung region 1107 may act as a mechanical anchor that may hold potting compound 1100 in place even if potting compound 1100 should lose its adhesion to edges 1101 of window 801. The existence of overhung region 1107 may thus provide additional insurance that the seal between potting compound 1100 and portion 1102 of bezel back side surface 805, edges 1103 of gasket apertures 701, a portion 1104 of the surface of circuit board 201, and the exposed surface 1105 of LED 100 may remain intact even if mechanical stress applied to outer surface 1108 of potting compound 1100 or other effects are able to cause potting compound 1100 to become detached from edges 1101 of light window 801.

Figure 12A:
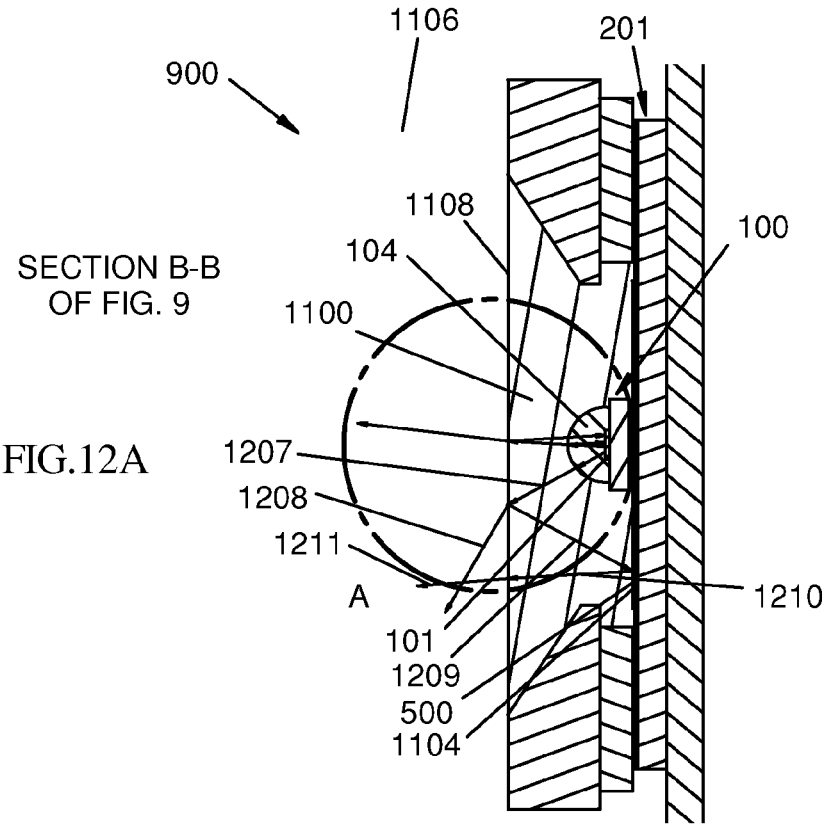
FIG. 12A shows a portion of the cross section in the plane B-B of FIG. 9 with various light paths indicated.
Figure 12B:
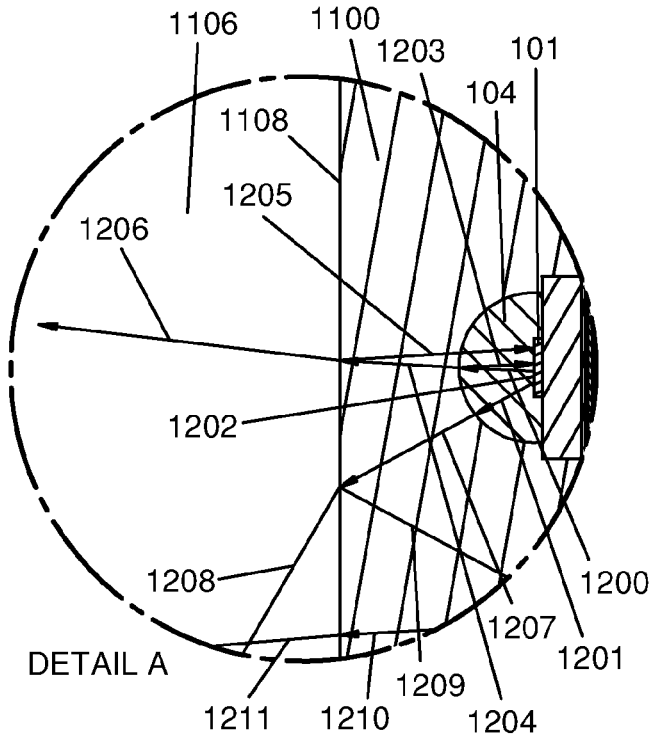
FIG. 12B shows details of the portion of cross section B-B enclosed by circle A in FIG. 12A.

FIG. 12A, which shows cross section B-B of FIG. 9, and FIG. 12B, which shows details of the portion of cross section B-B enclosed by circle A in FIG. 12A, includes rays with arrows indicating various light paths. Only features in the plane of cross section B-B are shown. To enhance the transmission of light from LED 100 to the outside 1106 of lamp subassembly 900, potting compound 1100 may be transparent and have a low index of refraction. It may also be lightfast, remaining clear and transparent under prolonged exposure to light. It may also be flexible to an extent necessary to prevent it from cracking or buckling, and to prevent it from dislodging LED lens 104 due to differential thermal expansion effects occurring in conjunction with temperature changes. In a preferred embodiment potting compound 1100 may be a silicone rubber compound with an index of refraction close to 1.4 and a Shore A durometer of approximately 50.

It will be seen presently that the structure revealed in FIGS. 12A and 12B may have several features acting to enhance the fraction of the light emitted by LED 100 that may exit to the outside 1106 of lamp subassembly 900. Rays 1200 and 1201 represent examples of paths that may be taken by light emitted from LED chip 101. Ray 1200 represents the path of light emitted in a direction more or less normal to the primary emission surface 1202 of LED chip 101. As shown, if LED chip 101 is packaged with a lens 104 encapsulating the chip, as is common in the art, ray 1200 may reach an interface between lens 104 and potting compound 1100. If the refractive index $r_l$ of the material composing lens 104 differs from the refractive index $r_p$ of the material composing potting compound 1100, a fraction of the light from ray 1200 may be reflected back to the LED chip 101 or to areas nearby, as shown by ray 1203, and the remainder of the light from ray 1200 may pass into potting compound 1100 as shown by ray 1204. Depending on where it strikes, much of the light in ray 1203 may be absorbed. To reduce the amount of light that is absorbed rather than being transmitted to the outside 1106, it is desirable to minimize the amount of light in ray 1203. As is commonly known in the field of optics, the fraction of light in reflected ray 1203 increases as the ratio of $r_l$ to $r_p$ deviates more from unity. The fraction of light in reflected ray 1203 may be minimized, therefore, when $r_p$ has a value close to the value of $r_l$. A typical value of $r_l$ for an LED lens 104 is approximately 1.52. In a preferred embodiment potting compound 1100 has an index of refraction of approximately 1.4. The fraction of light in reflected ray 1203 may therefore be lower than the fraction that would be reflected if the medium surrounding LED lens 104 were air with a refractive index of approximately 1.0. Potting compound 1100, therefore, may act to reduce the loss of light due to reflection from the boundary of lens 104 and the resulting absorption at or near LED chip 101.

The portion of the light in ray 1200 that is not reflected into ray 1203 may follow ray 1204 to the surface 1108 of potting compound 1100. Once again, a fraction of the light in ray 1204 may be reflected, as indicated by ray 1205. If the medium on the outside 1106 of lamp subassembly 900 is air with a refractive index of approximately 1.0, the fraction of the light from ray 1204 that is reflected into ray 1205 may be minimized if the value of $r_p$ is as close to unity as possible. In a preferred embodiment $r_p$ is approximately 1.4, which is among the lowest values available in a practical transparent elastomer. A large fraction of the light from ray 1204 may emerge from potting compound 1100 to the outside 1106 as shown by ray 1206. In a preferred embodiment the surface 1108 of potting compound 1100 is substantially parallel to the surface of LED chip 101. If a light ray 1204 is substantially normal to potting compound surface 1108, the transmitted ray 1206 will be substantially normal to this surface, as is well known in the field of optics. In the example shown, light ray 1204, like light ray 1200, will be substantially normal to the primary emission surface 1202 of LED chip 101 and hence to potting compound surface 1108 if the ratio of $r_p$ to $r_1$ is close to unity. This result follows from the well-known fact that there is very little refraction at interfaces between materials with nearly identical refractive indices.

Ray 1201 is an example of a direction of emission of light at a moderate angle to the normal to primary emission surface 1202. If the ratio of $r_p$ to $r_l$ is close to unity, the light in ray 1201 that passes through the interface between LED lens 104 and potting compound 1100 will be refracted only slightly, as shown by ray 1207 and may strike potting compound surface 1108 at a moderate angle to its normal. Light from ray 1207 that is transmitted to the outside 1106 may emerge along ray 1208. If the outside medium is air, the light in ray 1208 will emerge into a medium of lower refractive index than that of the medium from which the light in ray 1207 was incident. The angle of ray 1208 to the normal to potting compound surface 1108 will be greater than the angle of the incident ray 1207 to the same normal, as is well known in the field of optics. The rays shown in FIGS. 12A and 12B are representative of this case. It will be observed that rays 1206 and 1208 emerging to the outside 1106 are spread farther in angle than are the corresponding rays of emission 1200 and 1201. It should be apparent, then, that the structure of the present embodiment may spread the angles of emission of light from LED chip 101 out and thereby reduce the flux of light emitted directly from the primary emission surface 1202 into any particular angular range. The amount of directly emitted light that may enter the pupil of an eye of an observer at a particular distance from the LED 100 is thus reduced, and the chances that the observer may experience damage to the retina, on which directly emitted light may be focused, may be reduced.

For the example in FIG. 12 of light emission into ray 1201 it is shown that the portion of ray 1207 that is reflected at potting compound surface 1108, which portion is directed along ray 1209, may strike the surface portion 1104 of circuit board 201. Portion 1104 of circuit board 201 may be coated with light-reflecting background 500 shown in FIG. 5. In a preferred embodiment light-reflecting background 500 is highly reflective of light, and may reflect much of the light from ray 1209 into directions such as that of ray 1210 in which the light may escape to the outside 1106 as shown by ray 1211.

Figure 13A:
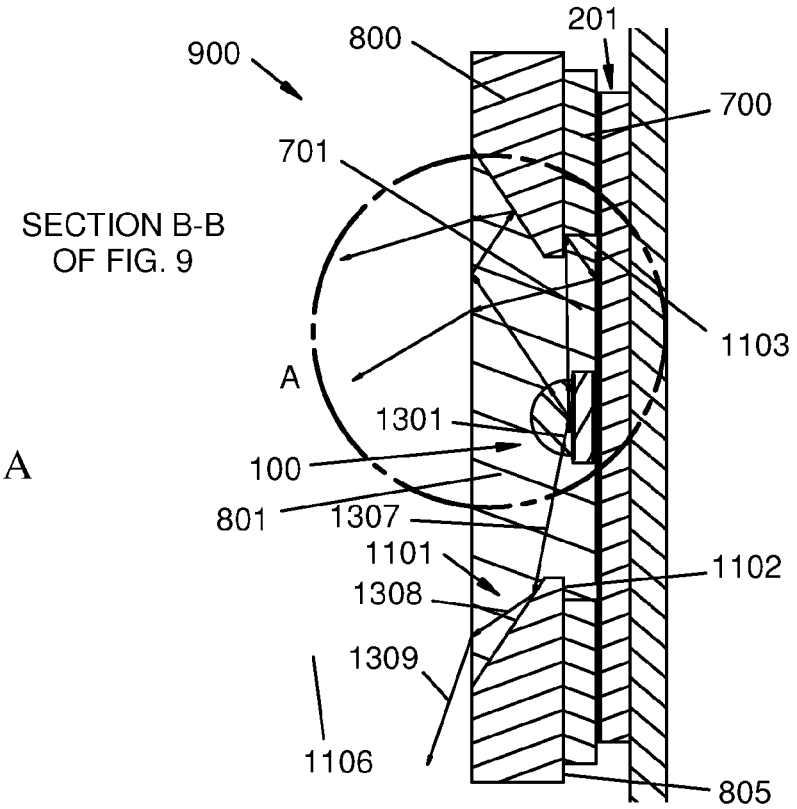
FIG. 13A shows a portion of the cross section in the plane B-B of FIG. 9 with various additional light paths indicated.
Figure 13B:
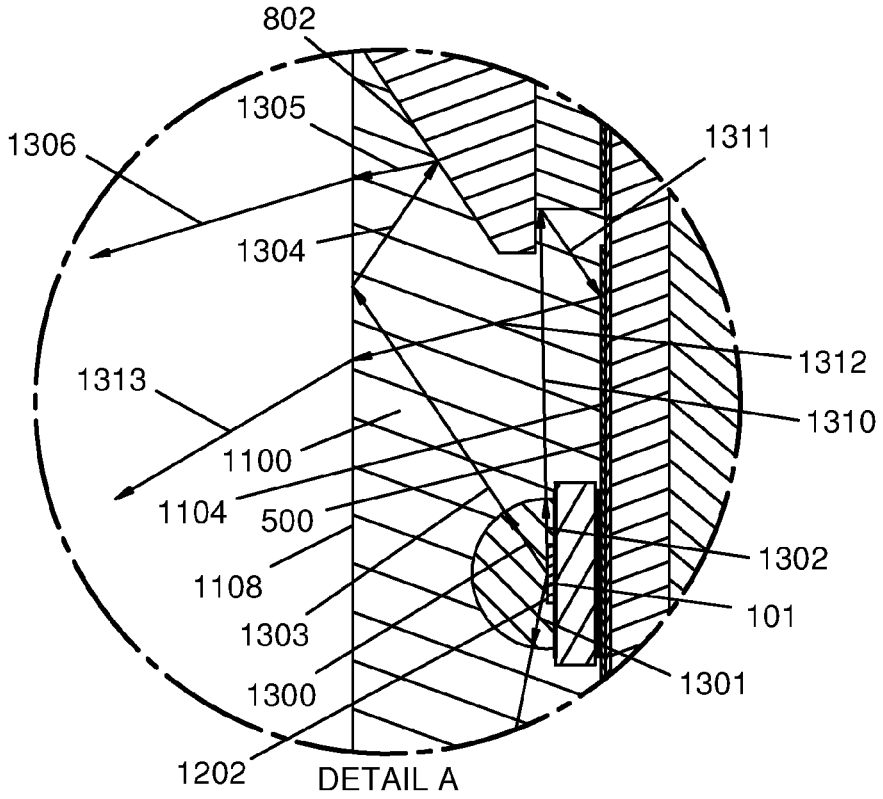
FIG. 13B shows details of the portion of cross section B-B enclosed by circle A in FIG. 13A.

FIG. 13A, which shows cross section B-B of FIG. 9, and FIG. 13B, which shows details of the portion of cross section B-B enclosed by circle A in FIG. 13A, includes rays with arrows indicating various light paths different from the light paths shown in FIGS. 12A and 12B. Only features in the plane of cross section B-B are shown. Rays 1300, 1301, and 1302 represent examples of high-angle paths that may be taken by light emitted from LED chip 101. Ray 1300 is an example of a light path at an angle to the normal to primary emission surface 1202 that leads to an angle of transmitted ray 1303 to the normal to the potting compound surface 1108 that exceeds the critical angle for the interface between potting compound 1100 and air. If the medium of the outside 1106 is air, none of the light in ray 1303 will be transmitted to the outside 1106, and essentially all of this light will be reflected. With the geometry as shown in FIG. 12 the reflected light traveling along ray 1304 will strike beveled edge 802. In a preferred embodiment beveled edge 802 may be highly reflective, and much of the light from ray 1304 may be reflected into directions such as that of ray 1305 in which the light may escape to the outside 1106 as shown by ray 1306.

Ray 1301 is an example of a light path at an angle to the normal to primary emission surface 1202 that leads to a transmitted ray 1307 that directly strikes an edge 1101 of light window 801. If edge 1101 is highly reflective, much of the light from ray 1307 may be reflected into directions such as that of ray 1308 in which the light may escape to the outside 1106 as shown by ray 1309.

Ray 1302 is an example of a light path at an angle to the normal to primary emission surface 1202 that leads to a transmitted ray 1310 that strikes an edge 1103 of gasket aperture 701. If gasket 700 is highly reflective, much of the light from ray 1310 may be reflected into directions such as that of ray 1311, which may strike, for example, portion 1104 of circuit board 201 that may be occupied by light-reflecting background 500. If light-reflecting background 500 is highly reflective, much of the light from ray 1311 may be reflected into directions such as that of ray 1312 in which the light may escape to the outside 1106 as shown by ray 1313.

It may be observed that rays 1211, 1306, 1309, and 1313 are examples of indirect rays. That is, these rays come from reflected light and not from light transmitted directly from primary emission surface 1202. Because the points at which the light in these rays are reflected are generally distant from primary emission surface 1202, the light of such rays will generally not be focused on the same portions of the retina of an observer's eye as may the light of direct rays. The fact that some of the light emitted by LED 100 becomes indirect thus may reduce the peak intensity of light on the retina of the observer's eye and may reduce the likelihood of damage to the retina.

It may also be observed from the several examples of light paths discussed that scattered light may impinge on any of the surfaces of objects bounding potting compound 1100. These surfaces include edges 1101 of light window 801, portion 1102 of bezel back side surface 805, edges 1103 of gasket aperture 701, and portion 1104 of circuit board 201. These surfaces may be made highly reflective so that little of the scattered light will be absorbed and most of the scattered light will make its way to the outside 1106. The reflective surfaces may be white, in which case the reflection is diffusive, or they may be specularly reflective, or they may have reflective properties that are partially diffusive and partially specular. In a preferred embodiment gasket 700 may be composed of a white material, portion 1104 of circuit board 201 may be entirely occupied by a light-reflecting background 500 that is composed of white silkscreen ink, and bezel 800 may be composed of polished or bright-dipped aluminum that may be coated to enhance reflection.

Proper choice of the various geometric factors combined with proper choice of the diffusivity or specularity of the reflection from various surfaces may enhance the amount of light reaching the outside 1106. The geometric factors may include the size and shape of light window 801, the shape of the edges of light window 801 including the angle of the bevel on a beveled edge 802, the size and shape of gasket aperture 701, and the height and shape of surface 1108 of potting compound 1100. The choice of diffusivity or specularity applies as discussed previously, but the most critical aspect may be the finish on a beveled edge 802. One preferred embodiment may have a polished aluminum finish, another may have a bright-dipped aluminum finish, and another may have a white coating such as paint, a plasma-sprayed coating, a powder-sprayed coating, or a coating of white silicone rubber. In a particular preferred embodiment a white silicone compound containing a pigment in the form of a powder of such a substance or substances as barium sulfate, titanium dioxide, alumina, or magnesia may be applied in liquid form to beveled edge 802 to produce a highly-reflective white coating. An adhesion-promoting primer may be applied prior to application of the white silicone compound. The white silicone compound may be partially or fully cured prior to the casting of potting compound 1100, the choice of degree of cure being made to assure strong adhesion of potting compound 1100 to the white silicone compound.

The potting compound 1100 may be cast as follows. An amount of catalyzed liquid silicone precursor may be poured into the cavity 1109 surrounding each LED 100. The amount may be adjusted so that the final level of the surface 1108 of the potting compound 1100 reaches a height that has been determined to result in a high degree of light extraction. The potting compound 1100 may then be cured to form the silicone rubber. A silicone compound that cures to a textured finish may be utilized to achieve extra diffusion of the light, if such extra diffusion should be desired for safety or other reasons. Alternatively, the surface 1108 of potting compound 1100 may be molded during cure to achieve a shape of or finish to surface 1108 that results in a high degree of light extraction and/or improves safety.

It should be noted that there are numerous other materials of which potting compound 1100 may be composed, including without limitation various plastics or glasses or multilayer composites, and that there are numerous other methods by which potting compound 1100 may be formed, including without limitation vacuum deposition, spray deposition, or injection molding.

Figure 14A:
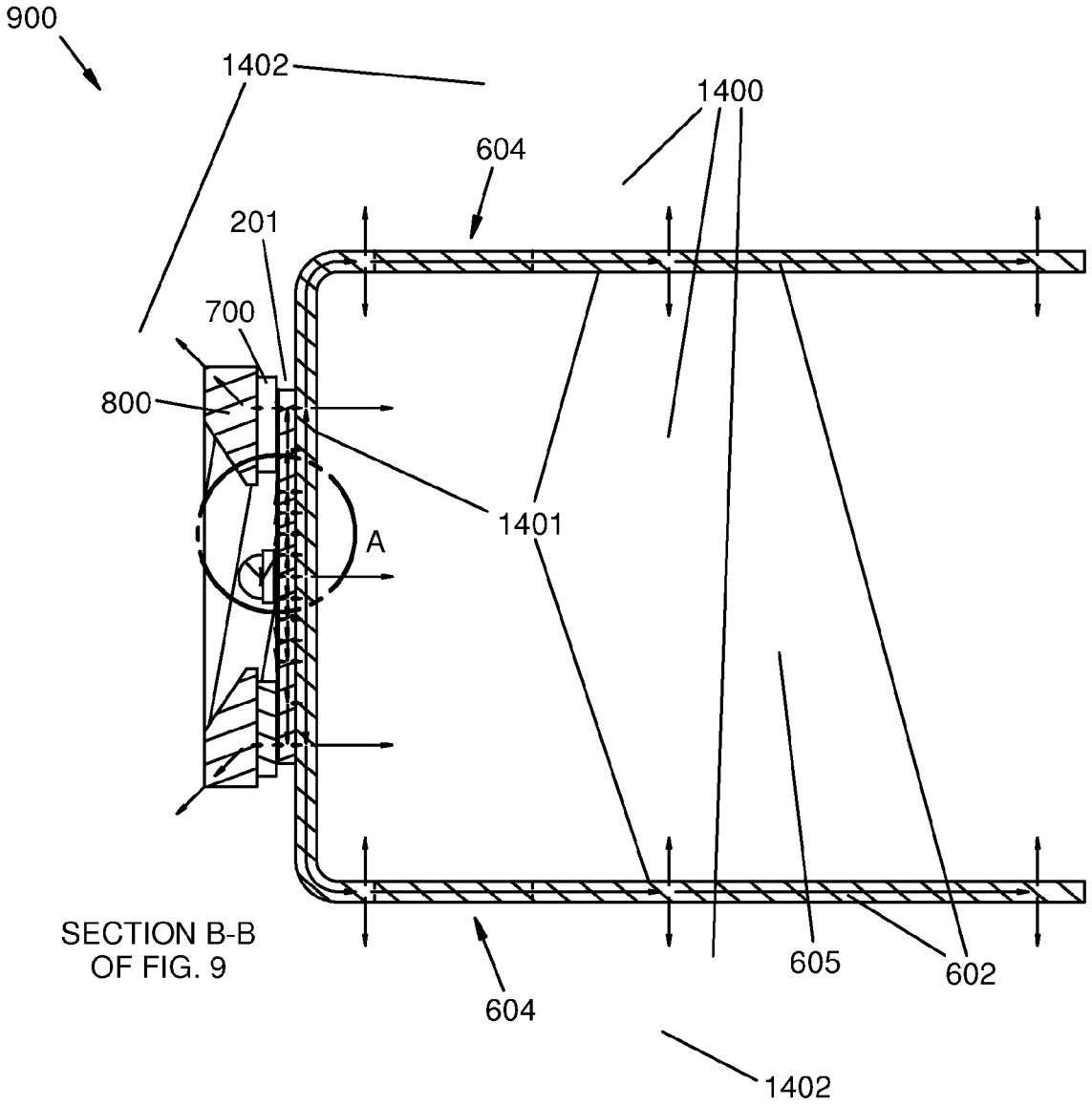
FIG. 14A is a cross-sectional view of the lamp subassembly in the plane B-B of FIG. 9 showing paths of heat flow.
Figure 14B:
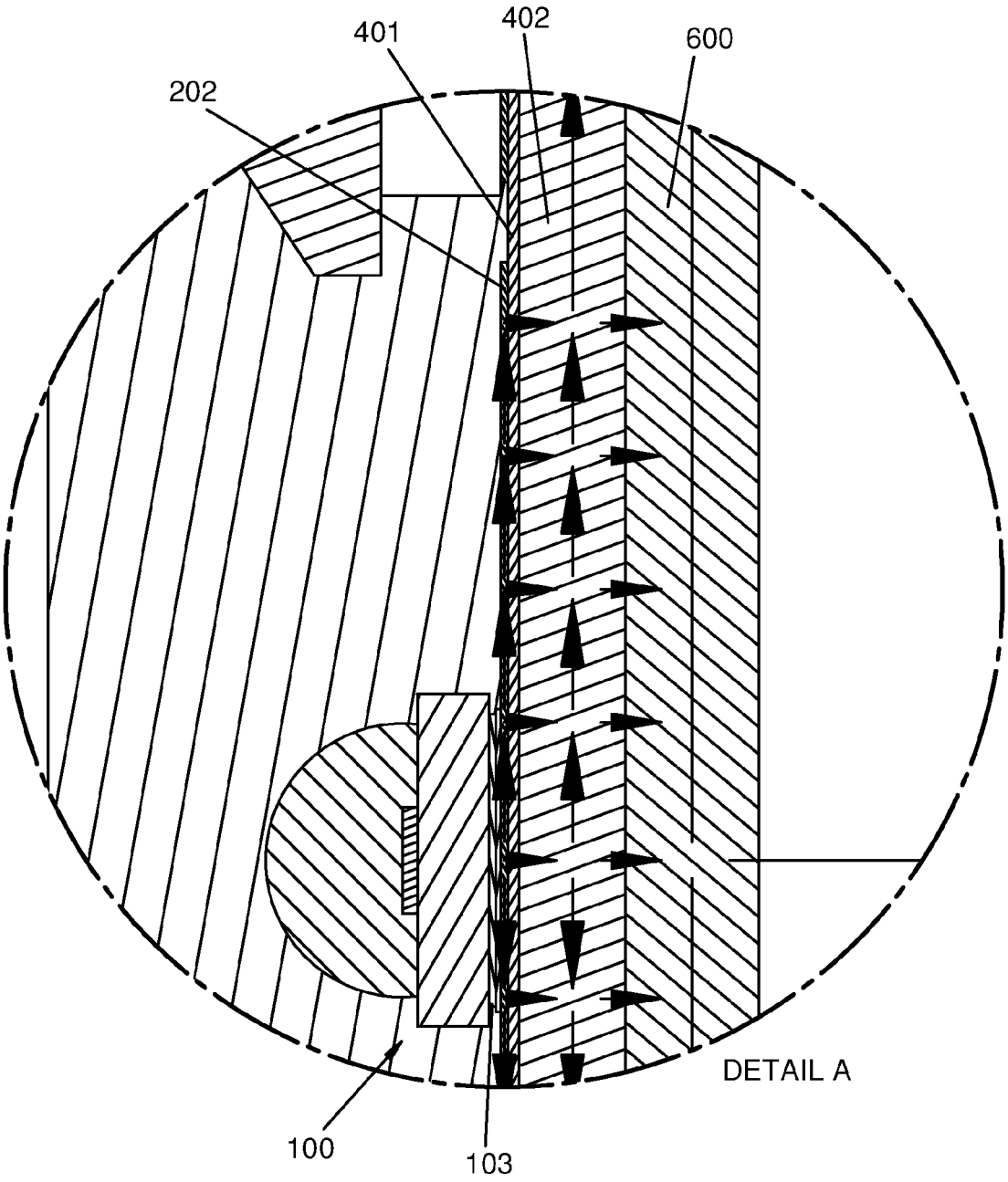
FIG. 14B shows details of the portion of cross section B-B enclosed by circle A in FIG. 14A.

FIG. 14A, which shows cross section B-B of FIG. 9, and FIG. 14B, which shows details of the portion of cross section B-B enclosed by circle A in FIG. 14A, includes arrows to show paths of heat flow. It will be observed that heat generated by LED 100 flows from a thermal pad 103 on LED 100 into patterned conducting layer 202, where some of the heat is spread laterally. The heat flows from patterned conducting layer 202 through electrically insulating layer 401 into backing layer 402 in which some of the heat may spread further before crossing into heat sink 600. Heat spreads further in heat sink 600 and enters fins 602. Convection carries heat into the surrounding air 1400 from all exposed parts of the surface of heat sink 600. Ventilation holes 604 may facilitate air flow through semi-enclosed space 605 to aid convective cooling at inner surfaces 1401 of heat sink 600.

Some heat may also flow from circuit board 201 through gasket 700 into bezel 800 where additional convection may carry heat into the surrounding air 1400.

It may be observed that patterned conducting layer 202, backing layer 402, and heat sink 600 may act as heat spreading layers that increase the area over which heat may flow through less thermally conducting layers or interfaces including electrically insulating layer 401, the interface between backing layer 402 and heat sink 600, and the convective interface between heat sink 600 and the surrounding air 1400. To enhance the heat spreading and thereby reduce the overall thermal resistance from LED 100 to air it may be desirable that the heat spreading layers be composed of high-thermal-conductivity materials with a maximum thickness consistent with cost and other constraints. In a preferred embodiment patterned conducting layer 202 may be composed of copper approximately 0.0014 inches thick, backing layer 402 may be composed of 6061-T6 aluminum alloy approximately 1 millimeter thick, and heat sink 600 may be composed of 5052 aluminum alloy approximately 0.050 inches thick.

Figure 15A:
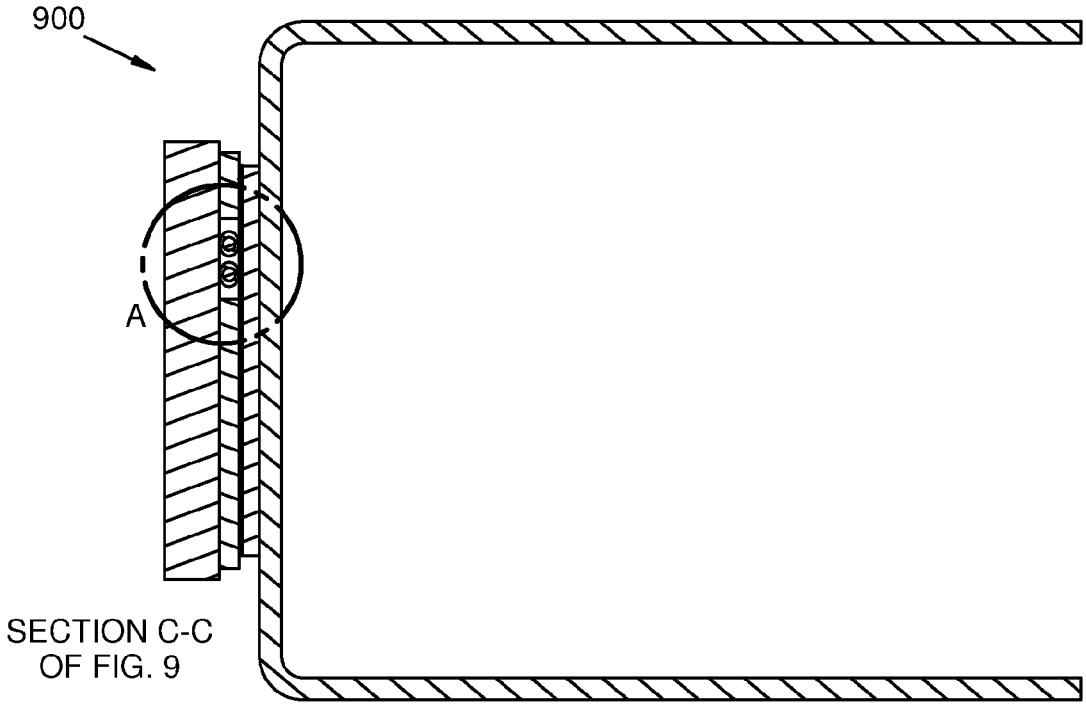
FIG. 15A is a cross-sectional view of the lamp subassembly in the plane C-C of FIG. 9 showing wires of a cable and a thixotropic sealant.
Figure 15B:
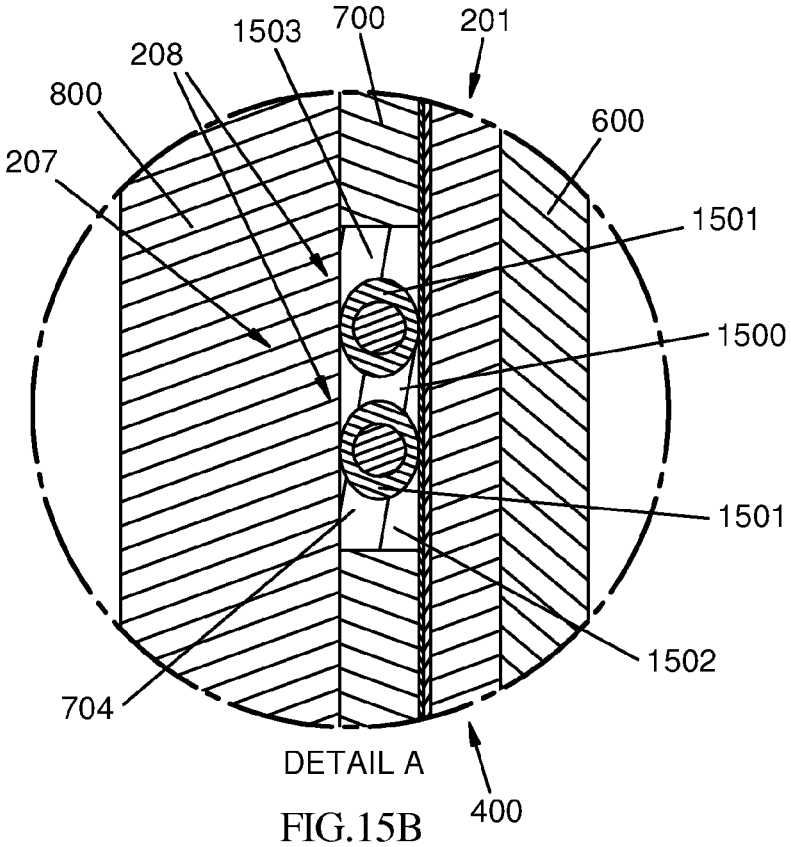
FIG. 15B shows details of the portion of cross section C-C enclosed by circle A in FIG. 15A.

FIG. 15A shows cross section C-C of FIG. 9, and FIG. 15B shows details of the portion of cross section C-C enclosed by circle A in FIG. 15A. One or more wires 208 from cable 207 passing through gap 704 in gasket 700 may be confined within a channel 1500. Channel 1500 may be bounded by circuit board 201, bezel 800, and gasket 700. Insulation 1501 on wires 208 may be compressed between bezel 800 and circuit board 201 thereby clamping wires 208 in place within channel 1500.

Figure 16A:
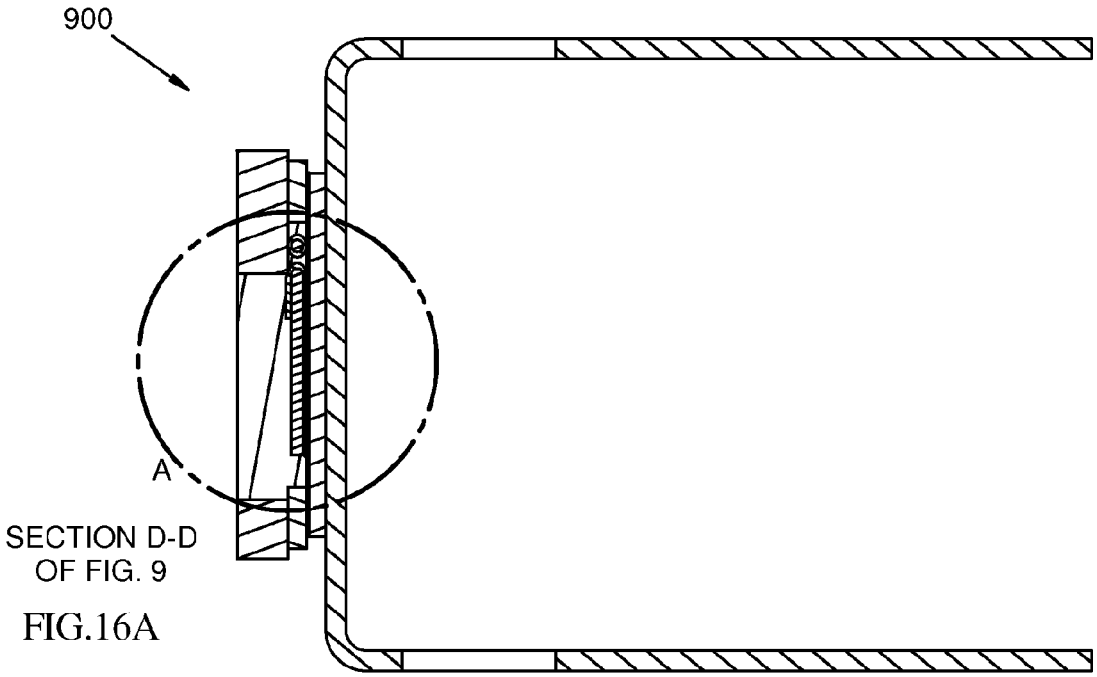
FIG. 16A is a cross-sectional view of the lamp subassembly in the plane D-D of FIG. 9 showing wires of a cable, a solder joint, and a terminal encapsulant.
Figure 16B:
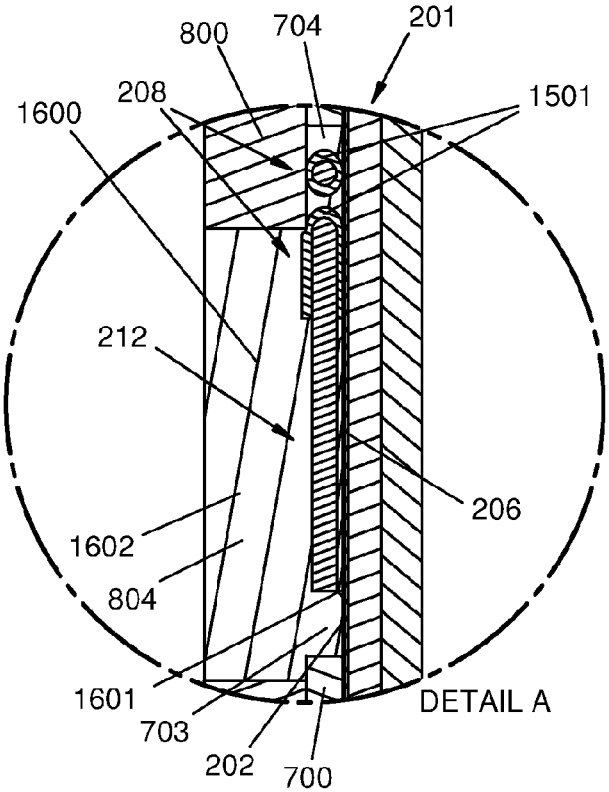
FIG. 16B shows details of the portion of cross section D-D enclosed by circle A in FIG. 16A.

FIG. 16A shows cross section D-D of FIG. 9, and FIG. 16B shows details of the portion of cross section D-D enclosed by circle A in FIG. 16A. In a preferred embodiment each terminal 206 on circuit board 201 has associated with it a terminal cup 1600 bounded in part by circuit board 201 and the edges of connection clearance hole 703 in gasket 700 and terminal window 804 in bezel 800. As shown in FIGS. 9, 16A, and 16B, wires 208 entering terminal cups 1600 through one or more gaps 704 may be stripped of their insulation 1501 over wire end portions 212 and may be electrically connected to terminals 206 by solder 1601 or other means within terminal cups 1600. In a preferred embodiment terminal cups 1600 may be filled with terminal encapsulant 1602 to prevent moisture or other contaminants from reaching stripped wire end portions 212, terminals 206, patterned conducting layer 202, or any solder 1601 or other electrically conducting material within terminal cups 1600. Terminal encapsulant 1602 may be composed of an electrically insulating material that may form a reliable seal with the bounding structures of terminal cups 1600. In a preferred embodiment terminal encapsulant 1602 is composed of the same material as is potting compound 1100, the material is transparent, and it may be cast in the same operation and by the same method as those used for potting compound 1100. Transparency of terminal encapsulant 1602 may have the advantage of allowing visual inspection of the terminal connections after encapsulation.

Referring to FIGS. 15A, 15B, 16A, and 16B, because wires 208 may enter terminal cups 1600 through one or more gaps 704 there may be spaces such as spaces 1502 in FIG. 15B through which terminal encapsulant 1602 may leak while in a liquid state during a casting operation. To prevent such an occurrence it may be desirable to fill spaces 1502 with a thixotropic sealant 1503 during or after assembly of gasket 700 and bezel 800 onto circuit board assembly 400 and heat sink 600. In a preferred embodiment a thixotropic one-part silicone sealant may be applied to insulated wires 208 within gap 704 for this purpose prior to assembly of bezel 800. The compressive effect of fasteners 901 may help to force the silicone sealant into spaces 1502.

In a preferred embodiment thorough curing of any thixotropic sealant 1503, terminal encapsulant 1602, and potting compound 1100 may be accomplished in one operation in which entire lamp subassembly 900 is heated to an elevated temperature in the range of approximately 100 to approximately 150 degrees centigrade for a period of time recommended by the manufacturer of the materials to be cured.

Figure 17A:
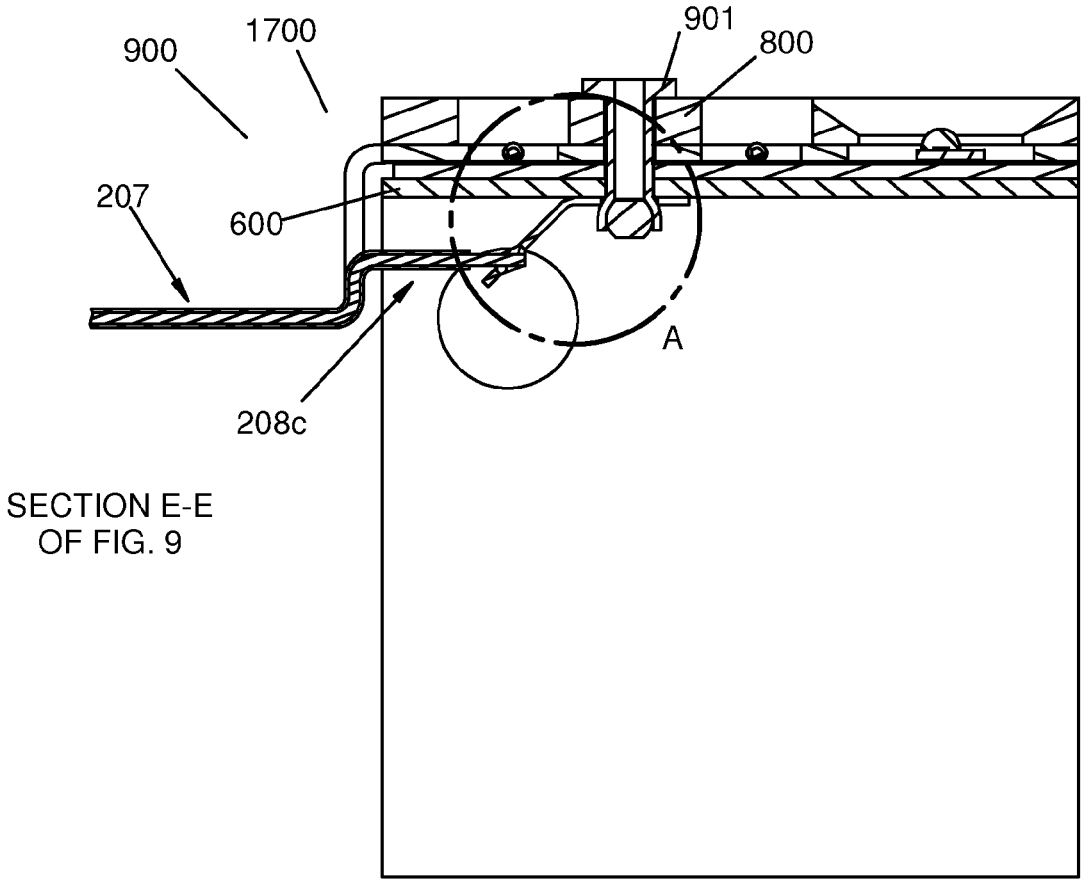
FIG. 17A is a cross-sectional view of the lamp subassembly in the plane E-E of FIG. 9 showing a ground wire attached to the lamp assembly through a solder lug.
Figure 17B:
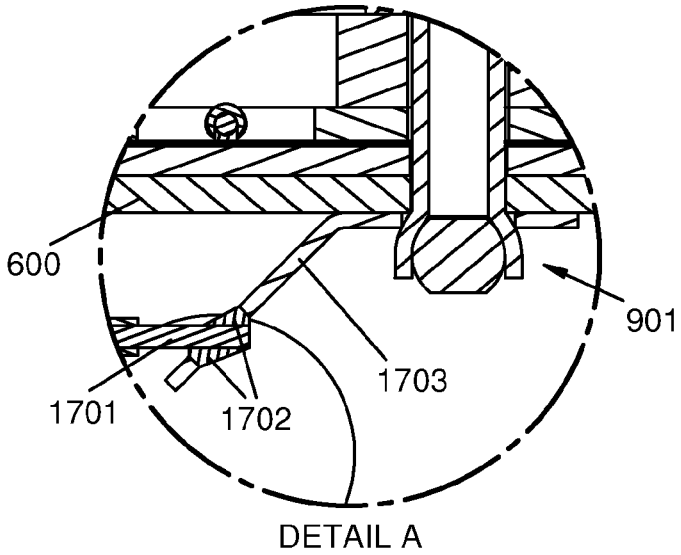
FIG. 17B shows details of the portion of cross section E-E enclosed by circle A in FIG. 17A.

To ensure electrical safety it may be desirable to connect exposed metal parts of lamp subassembly 900 to electrical ground through a wire 208*c* that may be a part of cable 207. FIG. 17A, which shows cross section E-E of FIG. 9 at one end 1700 of lamp subassembly 900, and FIG. 17B, which shows details of the portion of cross section E-E enclosed by circle A in FIG. 17A, illustrate how the connection may be made in a preferred embodiment of lamp subassembly 900. The stripped end 1701 of wire 208*c* may be attached with solder 1702 to a solder lug 1703 so that wire 208*c* is in electrical contact with solder lug 1703. Solder lug 1703 may be captured and held against heat sink 600 by a fastener 901 as shown. If heat sink 600 is composed of an electrically conductive material, the compressive force of fastener 901 may cause solder lug 1703 to make electrical contact with heat sink 600. Wire 208*c* may thus be electrically connected to heat sink 600. If fastener 901 is electrically conductive, the compressive force of fastener 901 against solder lug 1703 may cause solder lug 1703 to make electrical contact with fastener 901. If bezel 800 is electrically conductive, the compressive force of fastener 901 against bezel 800 may cause fastener 901 to make electrical contact with bezel 800. It may be observed, therefore, that with the configuration shown in FIG. 17 electrical connections may be made from the exposed conducting parts, which may include heat sink 600, bezel 800, and fastener 901, to wire 208*c*. In addition, backing layer 402 may make electrical contact with mounting area 601 of heat sink 600 if the compressive force of fastener 901 forces backing layer 402 and mounting area 601 into intimate contact. The end of wire 208*c* distal from the solder lug 1703 may be connected to electrical ground to complete the desired grounding of lamp subassembly 900.

Solder lug 1703 may be replaced by a crimp lug or by any of a number of other devices capable of connecting a wire to a fastener or to heat sink 600.

Figure 18:
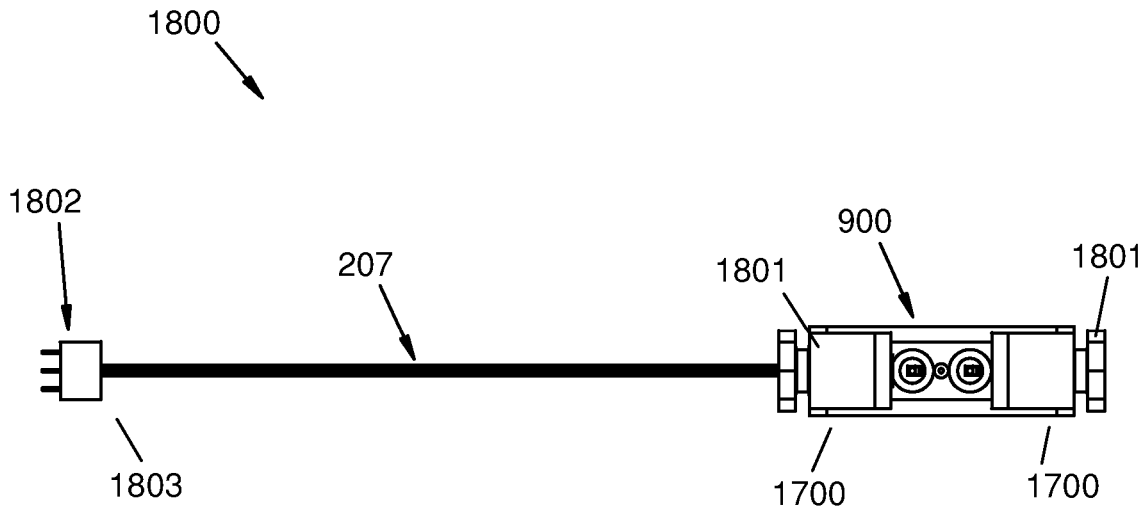
FIG. 18 is a top view of an exemplary lamp assembly showing its primary components.

FIG. 18 shows a drawing of an exemplary lamp assembly 1800, which may include lamp subassembly 900 and may include one or more end axles 1801 attached at one or both ends 1700. A cable connector 1802 may optionally be attached to an end 1803 of cable 207. End axles 1801 may allow lamp assembly 1800 to be rotated when installed in a suitable holder. End axles 1801 may have a number of features to be described as follows.

FIGS. 19A, 19B, 19C, 19D, and 19E show an end view, a side view, a top view, an opposite end view, and a bottom view respectively of a preferred embodiment of an end axle 1801. End axle 1801 may have a groove 1900 with a groove bottom 1901 cylindrical in shape with an axis 1902. End axle 1801 may have emerging from its outer end 1903 a hole 1904 the axis of which may be roughly coincident with axis 1902. Hole 1904 may widen or narrow or change its cross-sectional shape along its axis. In FIG. 19, for example, hole 1904 widens in region 1905 from its size at end 1903 to the larger size of a channel 1906, and at position 1907 the hole cross section changes shape from a circular cross section 1908 to the shape of a triangle 1909 with one rounded corner and two chamfered corners. Many other shapes at various positions are also feasible. Hole 1904 extends through the material into which groove 1900 is cut, and hole 1904 may extend along axis 1902 from end 1903 on a first side of groove 1900 to at least an inner end 1910 on the other side of groove 1900.

End axle 1801 may have an engagement extension 1911 shaped to allow an inner portion 1912 of engagement extension 1911 to fit within semi-enclosed space 605 shown in FIGS. 6B and 14A and/or an outer portion 1913 of engagement extension 1911 to fit into external space 1402 shown in FIG. 14A. Engagement extension 1911 may have appended to it or built into it one or more catches 1914 that are designed to engage attachment structures 607 on heat sink 600. In the preferred embodiment shown in FIGS. 6A, 6B, 19A, 19B, 19C, 19D, and 19E attachment structures 607 are in the form of circular attachment holes 608, and catches 1914 are in the form of beveled circular bosses designed to fit within attachment holes 608. In this embodiment end axle 1801 may be aligned to end 606 of heat sink 600 in such a way that inner portion 1912 of engagement extension 1911 may be inserted into semi-enclosed space 605 of heat sink 600, and then inner portion 1912 may be further slid into semi-enclosed space 605 under force. As inner portion 1912 slides into semi-enclosed space 605, the bevels 1915 on catches 1914 may push against the inner surfaces 1401 on fins 602 of heat sink 600 causing fins 602 to spread under tension. When inner portion 1912 slides far enough into semi-enclosed space 605 to position catches 1914 adjacent to attachment holes 608, fins 602 may relax back to their original positions, and catches 1914 may then find themselves extending into attachment holes 608. Because each catch 1914 has a bevel 1915 on one side only as shown, end axle 1801 is restrained from being extracted from heat sink 600 and is retained in a condition of being attached to lamp subassembly 900 as depicted in FIG. 18.

It will be clear to persons engaged in the art of mechanical engineering that attachment structures 607 and catches 1914 may take many forms besides those shown in the figures. As previously mentioned, attachment structures 607 may take the form of louvers, bumps, indentations, or other structures for facilitating attachment of parts, and catches 1914 may take the form of louvers, bumps, indentations, or other structures for engaging attachment structures 607. Moreover, attachment structures 607 may be incorporated into the bezel or another part connected to lamp subassembly 900 and need not be incorporated into heat sink 600, and these attachment structures may be engaged by catches 1914 appended, built-in, or attached to end axle 1801.

Included as part of an outer portion 1913 of engagement extension 1911 may be a cover 1916. When end axle 1801 is attached to lamp subassembly 900 as shown in FIG. 18, cover 1916 may enclose or cover terminal cups 1600 to protect or prevent access to these areas and/or to improve the visual appearance of lamp assembly 1800. One or more cutouts or holes 1917 may be included in cover 1916 to make room for or allow access to any fastener 901 that might otherwise interfere with cover 1916.

Engagement extension 1911 and catches 1914 may be designed to restrain end axle 1801 when attached to lamp subassembly 900 in an orientation such that axis 1902 is substantially parallel to the centroid of lamp subassembly 900 and such that the axes 1902 of end axles attached to each of the two ends 1700 of lamp subassembly 900 are substantially coincident. Hole 1904 may be designed such that a cable 207, which may include one or more wires 208 such as 208*a* and 208*b* emerging from one or more gaps 704 at an end of lamp subassembly 900 and may include one or more wires 208 such as 208*c* attached to a grounding point on lamp subassembly 900, may enter hole 1904 at inner end 1910 and emerge from hole 1904 at outer end 1903 when end axle 1801 is attached to lamp subassembly 900.

Figure 19A:
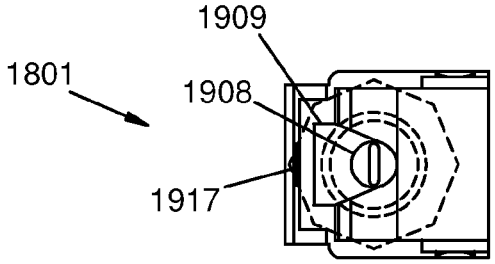
FIGS. 19A, 19B, 19C, 19D, and 19E show an end view, a side view, a top view, an opposite end view, and a bottom view respectively of an example of an end axle showing its various features.
Figure 19B:
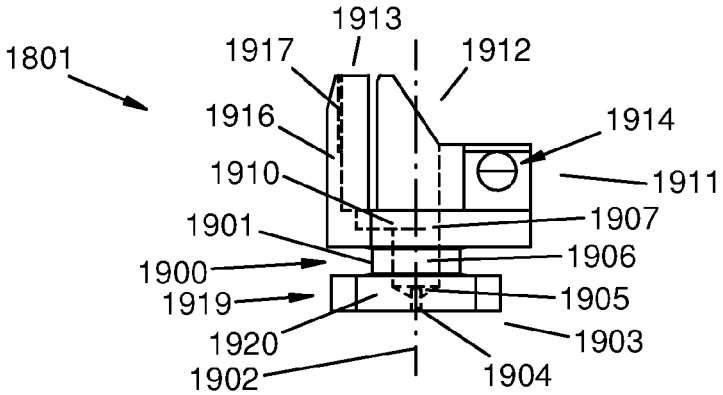
Figure 19C:
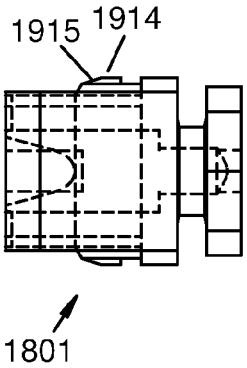
Figure 19D:
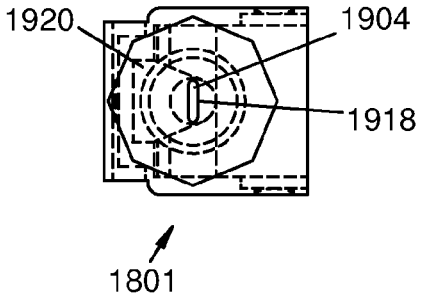
Figure 19E:
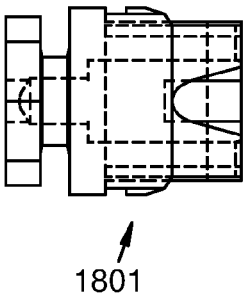

At some point along its length the cross section of hole 1904 may be flattened or otherwise deviated from circular symmetry and restricted in size in order to prevent cable 207 from being able to rotate relative to end axle 1801. For example, the cross section 1918 of hole 1904 at outer end 1903, as shown in FIG. 19D, is oblong and narrow such that a flat ribbon cable emerging through hole 1904 would not be able to rotate within hole 1904.

It may be desirable, also, that the cross section of hole 1904 be narrow enough at some point along its length to prevent a widened portion of cable 207 from being pulled through the hole. Cable 207 may be widened by way of tying a knot in one or more wires of the cable, applying around the cable a tight-fitting cable tie or clamp, molding a strain relief or additional insulation around the cable, or applying other means or a combination of these means. A widened portion of hole 1904 may be provided to allow space for a widened portion of cable 207. Channel 1906 is an example of such a widened portion. In a preferred embodiment two wires in cable 207 may be tied in an overhand knot that will fit within channel 1906 but that will not fit through the narrow portion of hole 1904 represented by cross section 1918. An externally-applied tension on cable 207 may be resisted by the force of the narrow portion of hole 1904 against the knot. If there is slack in cable 207 beyond the knot, there may be very little tension in the part of cable 207 that enters lamp subassembly 900. The potential for damage to lamp assembly 1800 due to externally-applied tension on cable 207 may therefore be reduced.

In a preferred embodiment the design of end axle 1801 may be such that in the completed lamp assembly 1800 axis 1902 of end axle 1801 passes approximately through the center of mass of lamp assembly 1800 so that gravity will exert little or no torque about axis 1902.

End axle 1801 may have an end portion 1919 shaped, as shown by example in FIG. 19, to act as a knob 1920 that can facilitate manual rotation of lamp assembly 1800 about axis 1902.

Two end axles 1801, one at each end of lamp assembly 1800, need not be identical to each other and need not have all of the features described. One may have a hole 1904 while the other may not. One may have a knob 1920 while the other may not. One may have a cover 1916 while the other may not. They may also differ in shape and size or in the type of catch 1914 used. One end axle 1801 may be entirely omitted.

While particular embodiments of a lamp assembly 1800 have been described, there are numerous other examples that may be contemplated. Light-emitting devices of other types may be used in place of LEDs (100). These other types of light-emitting devices may include incandescent lamps, discharge lamps, electroluminescent devices, or semiconductor lasers, for example. Heat sink 600 may be flat or may be bent into any of numerous shapes, and portions of heat sink 600 may act as reflecting surfaces that affect the distribution or direction of light emission from lamp assembly 1800, for example. Gasket 700 may be composed of an elastic material or an inelastic material and may be fluorescent, transparent, translucent, or opaque, for example. Gasket 700 may be devoid of apertures 701, fastener clearance holes 702, clearance holes, and or gaps 704. Bezel 800 may be composed of a material such as glass or plastic and may be transparent or fluorescent, for example. Bezel 800 may be devoid of light windows 801, mounting holes 803, and/or terminal windows 804. Portions of gasket 700 or of bezel 800 may act as lenses that affect the distribution or direction of light emission from lamp assembly 1800, for example.

In more general terms, a lamp assembly may comprise: a circuit board having an electrically insulating layer of material, a thermally conductive backing layer, and one or more electrically conductive traces disposed on a first major surface of the electrically insulating layer of material an opposing surface of which is in thermal contact with a surface of the thermally conductive backing layer; one or more light-emitting devices disposed on the circuit board, in thermal contact with the circuit board, and in electrical contact with at least one of the electrically conductive traces; a heat sink composed of thermally conductive material a surface of which is in thermal contact with the thermally conductive backing layer; a gasket having a first surface and an opposing second surface, the first surface being in mechanical contact with a surface of the circuit board; a bezel a surface of which is in mechanical contact with the second surface of the gasket; and one or more fasteners configured to apply force between the bezel and the heat sink resulting in the application of pressure between the bezel and the gasket, between the gasket and the circuit board, and between the circuit board and the heat sink.

In further examples, the one or more fasteners may include a screw or a rivet that either passes through or engages the bezel and either passes through or engages the heat sink, and/or the one or more fasteners may include a clamp or a clamping mechanism.

In further examples, the one or more electrically conductive traces may include a first electrically conductive trace in proximity to an edge of the circuit board, the presence of which first electrically conductive trace results in a raised portion of the circuit board, which raised portion is in contact with the gasket. In further examples of this case, the first electrically conductive trace may be continuous along and spaced from the edge, and may form a border that separates a portion of the circuit board near the edge from a portion of the circuit board distal from the edge; and/or the first electrically conductive trace may be not electrically connected to a light-emitting device, and in some examples may be not electrically connected to any other electrical conductor.

In further examples, the lamp assembly may comprise an electrically conductive wire a first end of which is electrically connected to the circuit board and a second end of which is distal to the circuit board, the gasket, and the bezel. In further examples of this case, a gap may extend through the gasket, through which gap the electrically conductive wire passes; and, in some examples, the circuit board, the bezel and the gasket may form a tunnel through which the electrically conductive wire passes, wherein space in the tunnel not occupied by the electrically conductive wire is filled with a sealant to prevent flow of fluids through the tunnel, wherein, in some examples, the sealant may be a silicone rubber material, and/or the bezel and the circuit board may exert sufficient pressure from opposing sides on the electrically conductive wire extending through the gap to resist movement of the electrically conductive wire through the gap.

In further examples, the gasket may be composed of a material that is reflective of light, its reflectivity being at least fifty percent.

In further examples the gasket may be composed of a silicone rubber compound, which in some examples may contain particles that reflect light and cause the silicone rubber compound to reflect light, its reflectivity being at least fifty percent.

In further examples, a portion of the surface of the circuit board may be coated with a coating substance that is reflective of light, its reflectivity being at least fifty percent; wherein, in some examples, the coating substance may include a white or silver-colored soldermask material, and/or the coating substance may include a white or silver-colored silkscreen ink.

In further examples, the bezel may include a window configured to allow light emitted by a light-emitting device to escape from the lamp assembly; wherein, in some examples, the edges of the window may be beveled in a manner that reduces the amount of emitted light striking the bezel, and/or the window may be filled with a transparent material in such a way that fluids may not flow through the window to reach the light-emitting device or the circuit board. In the latter case, in further examples, the transparent material may make optical contact to the light-emitting device and may have an index of refraction between that of the surrounding atmosphere and that of the surface of the light-emitting device from which light is emitted; and/or the transparent material may be clear silicone rubber; and/or the beveled surface may be reflective of light, its reflectivity being at least fifty percent, and the angle of the bevel may be between 20 and 80 degrees with respect to the normal to the major plane of the window; and/or the surface of the transparent material that is distal to the light-emitting device may have a shape that through refraction distributes the light emerging from the lamp assembly over a wide range of angles, and wherein, in further examples, the surface of the transparent material that is distal to the light-emitting device may have a shape that is flat, concave, meniscus-shaped, or multi-faceted; and/or a portion of the transparent material may contain light-scattering elements such as particles or bubbles.

In further examples, the lamp assembly further comprising an electrically conductive wire a first end of which is electrically connected to the circuit board and a second end of which is distal to the circuit board, the gasket, and the bezel may further comprise an end axle mechanically attached to the heat sink and/or the bezel, the end axle including a shaft portion capable of being rotated in a bearing. In further examples of the latter case, the end axle may include a passageway along the axis of the shaft portion, through which passageway the electrically conductive wire passes; and/or the end axle may include a knob on an end distal to the bezel and the heat sink, which knob may facilitate rotation by hand of the lamp about the axis of the shaft portion; and/or the end axle may include a first widened portion at a first end of the shaft portion, which first widened portion may extend beyond the radius of the shaft portion in a direction normal to the axis of the shaft portion. In the latter case, in some examples, the end axle may include a second widened portion at a second end of the shaft portion, which second widened portion may extend beyond the radius of the shaft portion in a direction normal to the axis of the shaft portion.

Figure 20A:
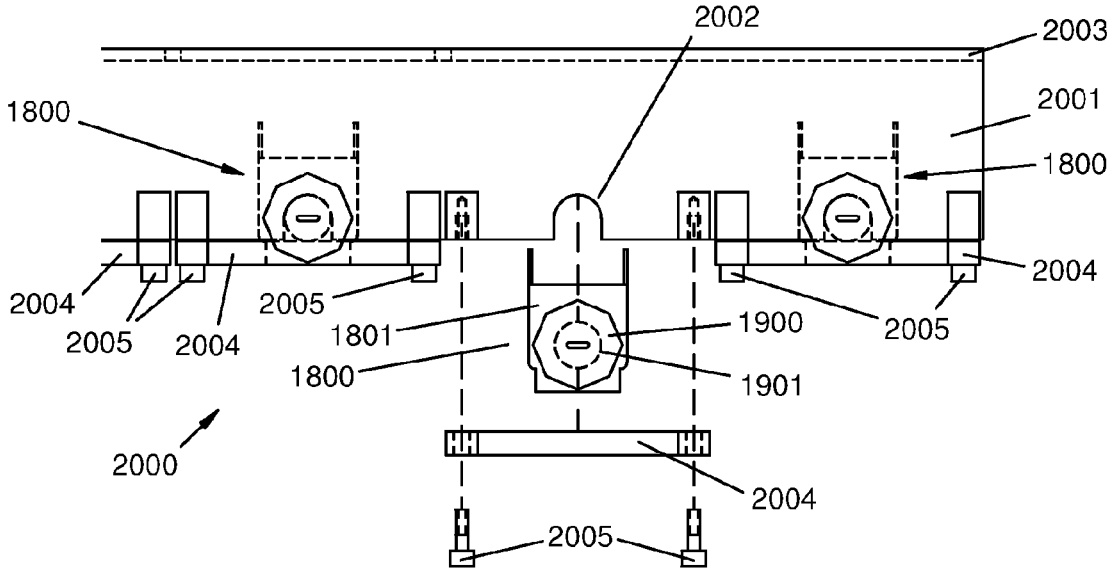
FIGS. 20A and 20B show an end view and a top view respectively of an example of a bearing assembly and shows how one or more lamp assemblies may be assembled to it.
Figure 20B:
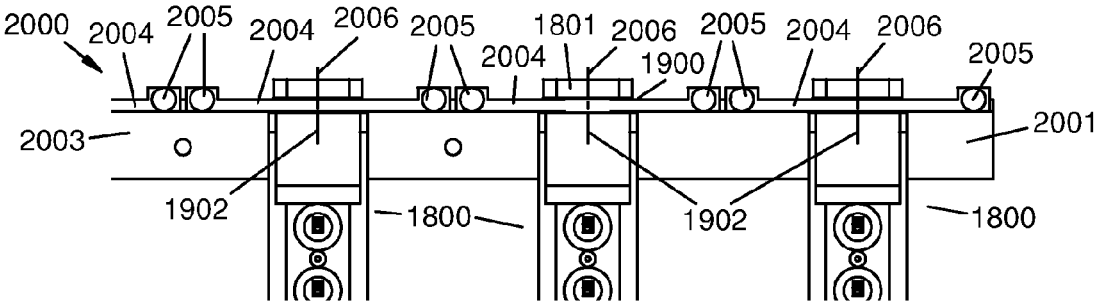
Figure 20C:
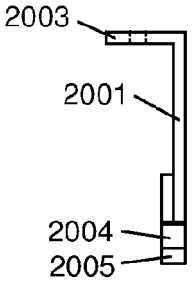
FIG. 20C shows a side view of just the bearing assembly of FIGS. 20A and 20B.

FIGS. 20A, 20B, and 20C show an end view, a top view, and a side view of an example of a bearing mount 2000 that may be used to hold the ends of one or more lamp assemblies 1800. Included in FIGS. 20A and 20B are lamp assemblies 1800, showing how the parts fit together. Bearing mount 2000 may include a stand 2001 that may have at one edge a bearing portion 2002 shaped to fit into groove 1900 in end axle 1801 and partially around groove bottom 1901. Stand 2001 may include a mounting portion 2003 with features designed to facilitate secure attachment of stand 2001 to a support (not shown). Bearing mount 2000 may also include a retainer 2004 that may be moved into or out of a position sufficient to block end axle 1801 from being removed from bearing portion 2002. Retainer 2004 may be a contiguous but flexible part of stand 2001, or it may be a separate part, as shown in FIG. 20, that may be assembled to stand 2001. Bearing mount 2000 may also include one or more fastening devices 2005 that may be adjustable for the purpose of varying the amount of friction exerted by bearing mount 2000 against end axle 1801 when the latter is being subjected to rotational torque about axis 1902 while stand 2001 is held stationary. The design of bearing mount 2000 may be such that lamp assembly 1800 may be suspended by bearing mount 2000 at one end of the lamp assembly 1800 without causing damage to bearing mount 2000 due to forces of gravity or specified amounts of vibration.

In a preferred embodiment as shown in FIGS. 20A and 20B stand 2001 may have multiple bearing portions 2002 to allow mounting of multiple lamp assemblies 1800. Stand 2001 and retainers 2004 may be composed of transparent acrylic plastic approximately 3/16 inches thick. Fastening devices 2005 may be metal thumbscrews. As will be appreciated by those skilled in the art, the acrylic plastic is but one of a wide variety of materials, including other plastics, metals, glasses, ceramics, or wood, with which the parts may be constructed, and the parts may take many possible shapes. In addition there may be many types of fastening devices 2005 other than thumbscrews that may be utilized, and fastening devices may be omitted altogether if friction or spring forces are sufficient to impede rotation.

In the example shown in FIGS. 20A, 20B, and 20C each lamp assembly may be individually oriented about an axis of rotation 2006. In a preferred embodiment the axis of rotation 2006 for a lamp assembly 1800 may be coincident with the axis 1902 of an end axle 1801 of that lamp assembly.

Figure 21A:
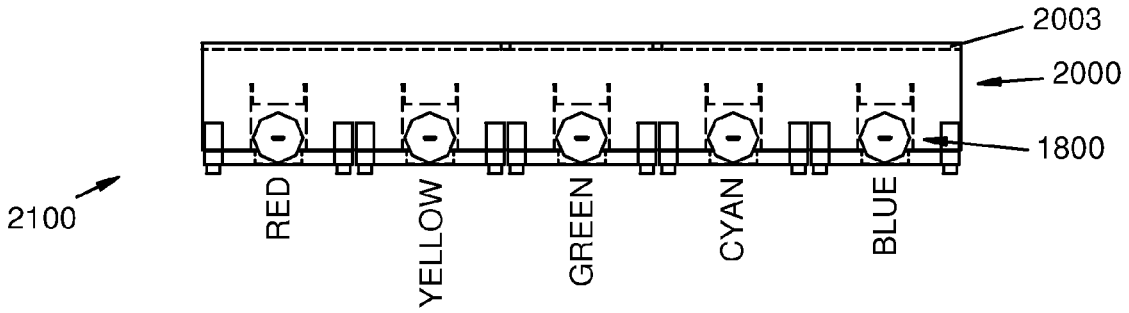
FIGS. 21A and 21B show an end view and a top view respectively of an example of an array of lamp assemblies mounted on bearing assemblies with the lamp assemblies in rows, emitting one color of light in each row.
Figure 21B:
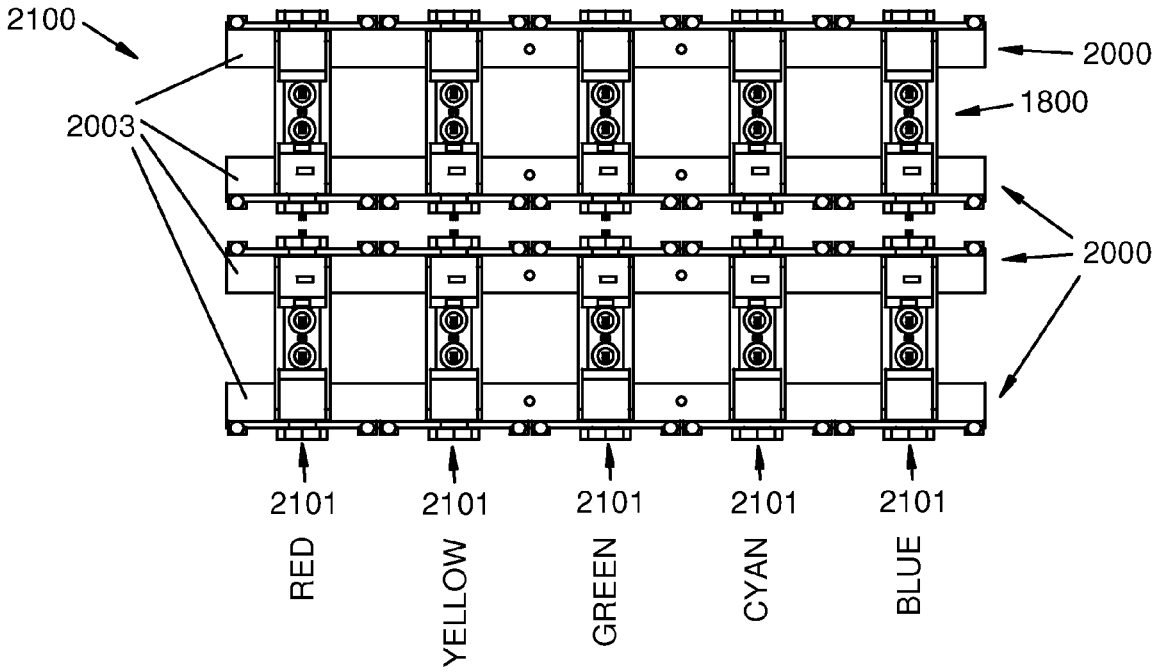

FIGS. 21A and 21B show two views of an exemplary lamp array 2100 including lamp assemblies 1800 mounted on bearing mounts 2000. The mounting portions 2003 may be attached to rails or to a flat surface or to other types of supports (not shown). In FIG. 21 lamp assemblies 1800 are arrayed with two collinear lamp assemblies 1800 in each of five rows 2101. The LEDs 100 in each row may emit light of one color. The color of the light emission may be different for each row 2101, as indicated in FIGS. 21A and 21B.

Figure 22:
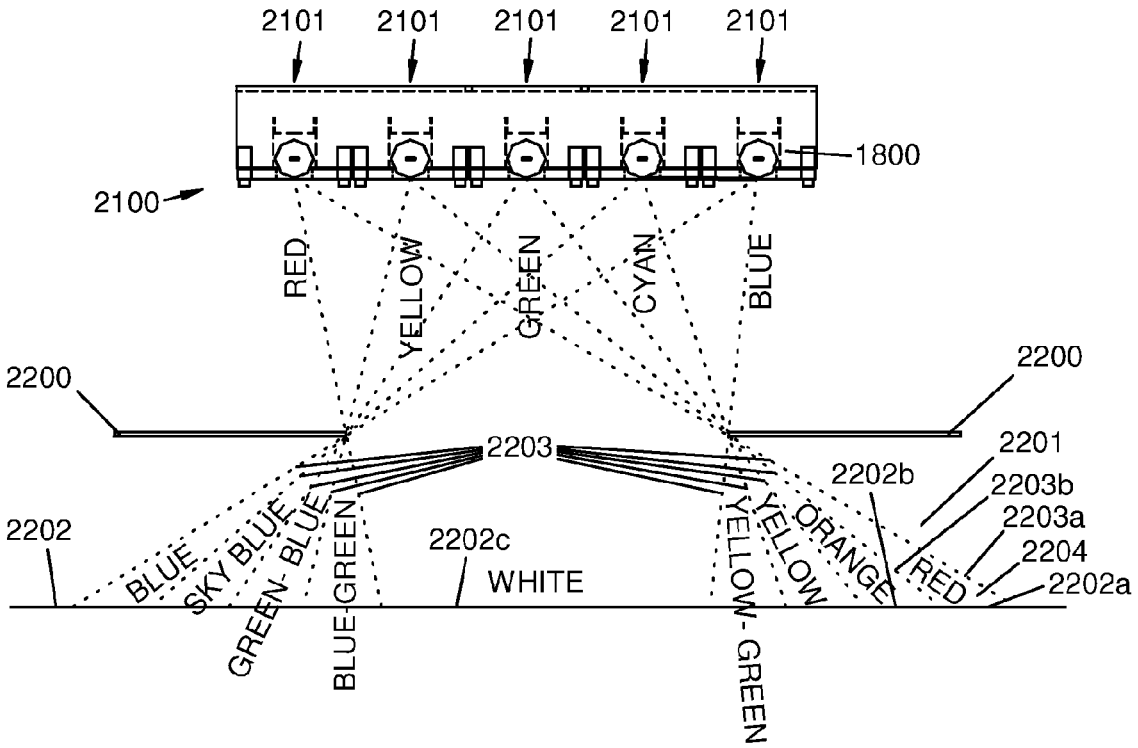
FIG. 22 is a diagram showing how shadows with rainbows of color at the edges may be created with an array of lamp assemblies like that of FIG. 21.

FIG. 22 shows the effect lamp array 2100 may have on shadows. An object 2200 may cast shadows 2201 on a surface 2202 when illuminated by light from lamp array 2100. The light from each LED 100 may cast a sharp or distinct shadow, because the light emanates from an area that is small relative to the spacing between LEDs. Each row 2101 of collinear LEDs may have associated with it a distinct shadow edge 2203. As a result, as will be readily understood by those skilled in the art of optics, each edge of an object 2200 may cast shadows with multiple colors, as indicated in FIG. 22. For example, in the region 2204 between red shadow edge 2203*a* and yellow shadow edge 2203*b* only red light is not shadowed, and portion 2202*a* of surface 2202 may be illuminated with red light only. By similar reasoning, portion 2202*b* of surface 2202 may be illuminated by red light and yellow light only and may appear orange in color. Portions 2202*c* of surface 2202 outside of shadows 2201 may be illuminated by all of the colors and may appear white. The overall effect is that lamp array 2100 may illuminate most areas with a white light but create rainbows of color at the edges of shadows.

Figure 23:
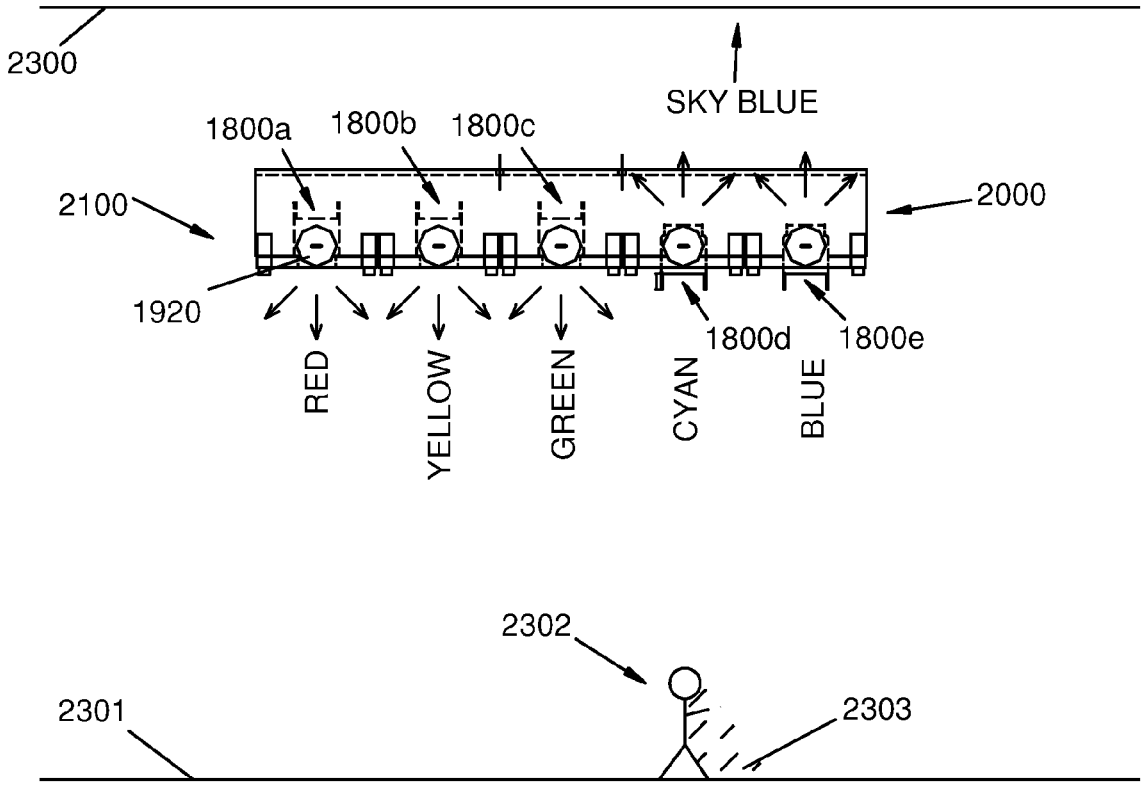
FIG. 23 is a diagram showing how daylight consisting of direct sunlight and indirect skylight may be emulated with an array of lamp assemblies like that of FIG. 21 but with some of the lamp assemblies rotated to radiate upward.

FIG. 23 illustrates lamp array 2100 configured to mimic clear-sky daylight illumination. Lamp assemblies 1800*a*, 1800*b*, and 1800*c*, which may emit red, yellow, and green light respectively may be rotationally oriented to radiate downward as shown. Lamp assemblies 1800*d* and 1800*e*, which my emit cyan and blue light respectively, may be rotationally oriented to radiate upward as shown. Rotational orientation of each of the lamp assemblies may be facilitated by knobs 1920 and bearing mount 2000.

The light from lamp assemblies 1800*a*, 1800*b*, and 1800*c* may directly illuminate surface 2301 and observer 2302 with a yellow-white light and may cast a distinct shadow 2303 just as does the sun on a clear day.

The light from lamp assemblies 1800*d* and 1800*e* may illuminate a diffusely reflective surface 2300 situated some distance above lamp array 2100. The light reflected by surface 2300 may be sky blue in color. This light may illuminate surface 2301 and observer 2302. This type of illumination is termed "indirect lighting" by those skilled in the art of illumination. If diffusely reflective surface 2300 is sufficiently distant from lamp array 2100, the indirect lighting may mimic the diffuse lighting from a clear blue sky on a sunny day. Shadow 2303 may be illuminated with this sky-blue light, just as shadows in sunlight are illuminated with sky-blue light from the sky.

Figure 24:
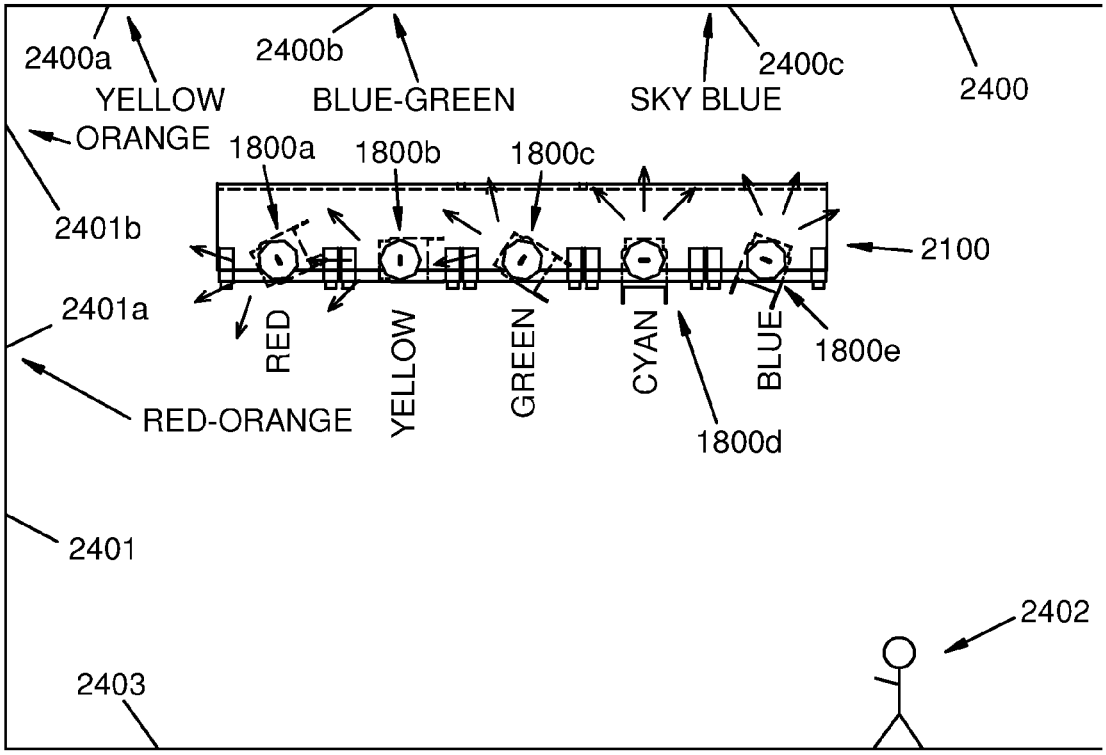
FIG. 24 is a diagram showing how rotating the various lamp assemblies appropriately in an array such as that of FIG. 21 can mimic within a room the color effects of a vivid sunset.

FIG. 24 illustrates how lamp array 2100 may be configured to mimic a sunset. Lamp array 2100 may be placed in a room with a ceiling 2400 and a wall 2401, both of which are substantially reflective to light. Lamp assembly 1800*a*, which may emit red light, may be rotated to a position that directs most of the light toward the middle portion of wall 2401 as shown. Lamp assembly 1800*b*, which may emit yellow light, may be rotated to a position that directs most of the light toward the upper-middle portion of wall 2401 as shown. Lamp assembly 1800*c*, which may emit green light, may be rotated to a position that directs most of the light toward the portion of ceiling 2400 nearest wall 2401 as shown. Lamp assembly 1800*d*, which may emit cyan light, may be rotated to a position that directs most of the light toward the portion of ceiling 2400 directly above lamp array 2100 as shown. Lamp assembly 1800*e*, which may emit blue light, may be rotated to a position that directs most of the light toward the portion of ceiling 2400 toward the side of lamp array 2100 farthest from wall 2401. An observer 2402 standing on the floor 2403 may observe a red-orange color on a middle portion 2401*a* of wall 2401, an orange color on an upper portion 2401*b* of wall 2401, a yellow color on a portion 2400*a* of ceiling 2400 near wall 2401, a blue-green color on a portion 2400*b* of ceiling 2400 above lamp array 2100, and a sky-blue color on a portion 2400*c* of ceiling 2400 above observer 2402. These colors and their positions are reminiscent of those observed during a colorful sunset.

It will be understood to those engaged in the art of optics that the principles illustrated in FIGS. 22, 23, and 24 will apply with varying effects under various changes in the configuration of lamp array 2100. For instance, though each lamp assembly 1800 is shown having two LEDs 100, each lamp assembly may include any number of LEDs 100. The maximum brightness of the illumination from lamp array 2100 may increase as the number of LEDs 100 in each lamp assembly 1800 increases. Though each row 2101 is shown having two lamp assemblies 1800, each row 2101 may include any number of lamp assemblies 1800, and the maximum brightness of the illumination from lamp array 2100 may increase as the number of lamp assemblies 1800 in each row 2101 increases. Different rows 2101 may include different numbers of lamp assemblies 1800. Though lamp array 2100 is shown having five rows 2101 each with its own color, lamp array 2100 may have any number of rows 2101, and there may be multiple rows 2101 of the same color or multiple colors within the same row 2101. The colors may differ from what is shown, and they may be placed in any order. The overall effect of unobstructed illumination from lamp array 2100 may be an appearance on portion 2202*c* of surface 2202 other than white.

In more general terms, a lamp array may comprise: two or more lamp assemblies, one of which supplies illumination with a first spectral characteristic and another of which supplies illumination with a second spectral characteristic different from the first spectral characteristic, each of which lamp assemblies includes two or more light-emitting devices, and a bearing mount having one or more bearings supporting each lamp assembly in a manner that allows each lamp assembly to be individually oriented rotationally about an axis of rotation.

In further examples, the light-emitting devices in each lamp assembly may be arranged in a line having a direction. In this case, in further examples, the lamp assemblies may be positioned such that the direction of the line is substantially the same for all of the lamp assemblies. In this latter case, in further examples, the lamp assemblies may be positioned in two or more rows in each of which the lines in which the light-emitting devices are arranged in the lamp assemblies are collinear and in which every lamp assembly in the same row supplies illumination with the same spectral characteristic. In this latter case, in further examples, the rows may all be substantially in the same plane and may be spaced between two inches and twelve inches apart, and/or the spectral characteristic of the lamp assemblies in each row may result in light of a distinct color, with the color of the light from a first row being substantially red, the color of the light from a second row being substantially red-orange or orange, the color of the light from a third row being substantially green, the color of the light from a fourth row being substantially cyan, and the color of the light from a fifth row being substantially blue or blue-violet.

Figure 25:
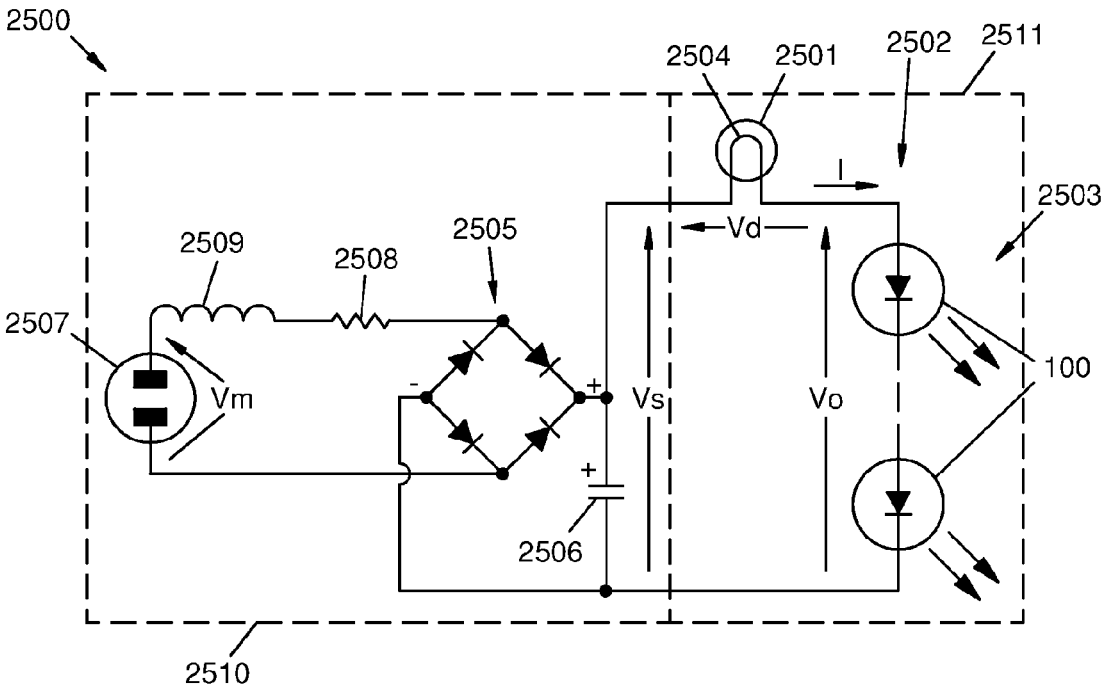
FIG. 25 is an electrical schematic diagram of an example of a circuit for providing electrical power to a series string of LEDs.

FIG. 25 shows the electrical schematic of an exemplary supply circuit 2500 that may be used to supply power to a lamp assembly 1800 or to a number of lamp assemblies 1800 electrically connected in series. In the embodiment shown it is assumed that the LEDs 100 in a lamp assembly 1800 are all connected in series. Supply circuit 2500 includes an incandescent lamp 2501 in series with the output 2502. Incandescent lamp 2501 may act as a variable resistor and current limiter and also may radiate heat and/or contribute some light output. The series-connected LED string 2503 creates an output voltage drop Vo that is only slightly dependent on the amount of current I through the string. If LED string 2503 were to be connected to supply voltage Vs directly, and if Vs were by chance several percent higher than the value of Vo at the maximum allowed current of the LEDs 100, current I might be much too high, resulting in a shortening of the life of LEDs 100. If incandescent lamp 2501 is inserted in series with LED string 2503 as shown, and if Vs is roughly 20 to 150 percent higher than Vo, a variation of Vs relative to Vo of several percent may result in a variation in current I that is much smaller than the variation that would occur without incandescent lamp 2501 in series with the circuit. An increase in current I would result in an increase in the voltage drop Vd across incandescent lamp 2501 by virtue of Ohm's law, since incandescent lamp 2501 is a resistor. Moreover, the increase in current I coupled with the increase in voltage drop Vd across incandescent lamp 2501 would result in an increase in power dissipation in incandescent lamp 2501, which would increase the temperature of the filament 2504 within incandescent lamp 2501, which, by virtue of a positive temperature coefficient of resistance of filament 2504, would increase the resistance of incandescent lamp 2501. The increased resistance of incandescent lamp 2501 would result in a further increase in voltage drop Vd. The result, as is well known in the field of electronics, is that current I would have to increase by only a relatively small amount to cause the increase in Vd to equal the increase in Vs relative to Vo, even if Vo does not increase. The insertion of incandescent lamp 2501 in series with LED string 2503 therefore acts to regulate the current I, keeping I more or less constant despite variations in Vs and Vo.

If LED string 2503 is to be run off of DC power, supply circuit 2500 may include a rectifier 2505 to convert AC power at mains voltage Vm to DC power. Supply circuit 2500 may also include a capacitor 2506 across the DC output of rectifier 2505 for the purpose of reducing the amount of AC ripple on voltage Vs and consequently the amount of ripple in the current I that flows through LED string 2503. Capacitor 2506 may also increase the degree of protection against power surges on the mains 2507, since capacitor 2506 may store moderate amounts of surge energy with just a minor increase in voltage Vs. Supply circuit 2500 may include a resistor 2508 in series with the mains 2507 to limit the peak of the charging current into capacitor 2506 to a level that will not damage rectifier 2505. Supply circuit 2500 may also include an inductor 2509 in series with the mains 2507 to reflect energy from fast-transient surges back into the mains 2507 and possibly also to improve the power factor of the circuit.

Incandescent lamp 2501 may provide some surge protection by virtue of its current regulating properties. In addition, incandescent lamp 2501 can act as a replaceable fuse that can further protect LEDs 100 from burnout due to lengthy surges or overvoltage conditions at the mains 2507.

In a preferred embodiment running off a mains voltage Vm of nominally 120 VAC with an LED string 2503 consisting of twenty LEDs all connected in series that are intended to be run at a current I of approximately 0.3 amperes, incandescent lamp 2501 may be a standard 60-watt, 120-volt light bulb. The resistance of such a light bulb's filament 2504 at room temperature may be typically 18 ohms, and with a supply voltage Vs of 120 V there may occur an initial surge of current I of up to 9 amperes through LED string 2503, which may typically present an output voltage drop Vo between 40 and 80 volts. Once filament 2504 warms up to its steady-state temperature, the resistance of incandescent lamp 2501 may typically reach approximately 200 ohms, and current I will typically settle to about 0.3 amperes.

If current I must be DC, then in a preferred embodiment optional rectifier 2505 consisting of a full-wave diode bridge may be added. Capacitor 2506 with a capacitance of 250 microfarads may be added to store surge energy and to reduce the ripple on supply voltage Vs to approximately 10 volts peak-to-peak, and optional resistor 2508 with a resistance of 2 ohms may be added to reduce the peak charging current through rectifier 2505 to under 100 amperes. Inductor 2509 with an inductance of 0.3 millihenries may be added to protect against fast-transient surges of up to approximately 6000 volts lasting for up to 20 microseconds. Inductor 2509 may be constructed as a coil of wire, and the wire size in this coil may be chosen such that the coil has resistance 2 ohms. The coil may thus function as both inductor 2509 and resistor 2508 simultaneously. The coil may or may not include a magnetic core.

The DC supply subcircuit 2510 consisting of inductor 2509, rectifier 2505, and capacitor 2506, with the optional addition of resistor 2508, as shown enclosed in dashed lines in FIG. 25, may be utilized to provide DC power with surge protection to circuits other than load subcircuit 2511 consisting of incandescent lamp 2501 in series with LED string 2503. Load subcircuit 2511 may, for example, be replaced with a switching current supply regulating the flow of current to an array of LEDs 100. Such a switching supply may be more efficient as a regulator than is an incandescent lamp, and such a switching supply may be designed to provide isolation between the mains 2507 and the LEDs 100 and/or to provide dimming capabilities.

Figure 26:
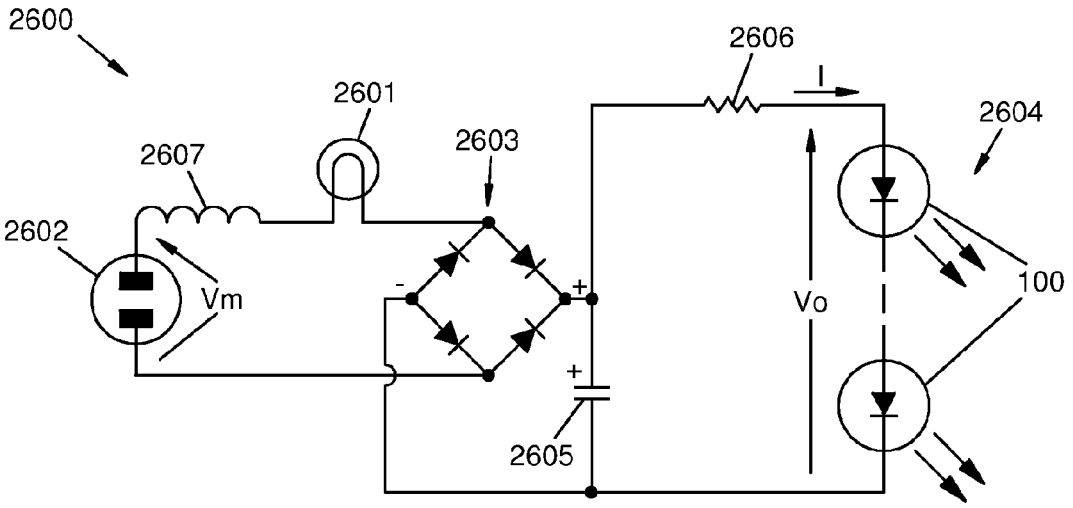
FIG. 26 is an electrical schematic diagram of another example of a circuit for providing electrical power to a series string of LEDs.

FIG. 26 shows the electrical schematic of an exemplary input-conditioned supply circuit 2600 that may be used to supply power to lamp assembly 1800. As in the supply circuit 2500 of FIG. 25, input-conditioned supply circuit 2600 utilizes an incandescent lamp 2601 to regulate current, but in this case incandescent lamp 2601 is placed in series with the mains 2602. Optional rectifier 2603 may be added, if LED string 2604 is to be supplied with DC current. Optional capacitor 2605 may be added to reduce ripple, but the addition of capacitor 2605 may make desirable the optional insertion of resistor 2606 in series with LED string 2604 to protect the LEDs 100 in LED string 2604 from potential burn-out due to surges in current I that might occur if LED string 2604 should be electrically connected across capacitor 2605 after capacitor 2605 has been charged to a voltage higher than output voltage drop Vo. The optional insertion of inductor 2607 in series with incandescent lamp 2601 may add protection against fast-transient surges.

An advantage of input-conditioned supply circuit 2600 is that incandescent lamp 2601 may act as a fuse or limiter that may protect against shorts in any of the remaining components of the circuit. In addition, incandescent lamp 2601, being a resistor, can perform in input-conditioned supply circuit 2600 the same function as does resistor 2508 in supply circuit 2500, limiting current surges through rectifier 2603 that may occur during the initial charging of a capacitor 2605. Input-conditioned supply circuit 2600 also may have the advantage of a more favorable power factor than that of supply circuit 2500 in cases in which a rectifier 2505 and 2603 and capacitor 2506 and 2605 are included in the respective circuits 2500 and 2600.

In a preferred embodiment of input-conditioned supply circuit 2600 operating with a mains voltage Vm of nominally 120 VAC supplying a current I of approximately 0.3 amperes to a lamp assembly 1800 with 20 LEDs 100 connected in series to form LED string 2604, incandescent lamp 2601 may be a standard 60-watt, 120-volt light bulb. If current I must be DC, then in a preferred embodiment optional rectifier 2603 consisting of a full-wave diode bridge may be added. Capacitor 2605 with a capacitance of 250 microfarads may be added to store surge energy and to reduce the ripple on supply voltage Vs to approximately 10 volts peak-to-peak, and optional resistor 2606 with a resistance of 80 ohms may be added to reduce the peak discharge current through LED string 2604 to under 2 amperes. Inductor 2607 with an inductance of 0.3 millihenries may be added to protect against fast-transient surges of up to approximately 6000 volts lasting for up to 20 microseconds. Inductor 2607 may be constructed as a coil of wire. The coil may or may not include a magnetic core.

In input-conditioned supply circuit 2600 a resistor 2606 large enough to limit surges in current I to a level below the absolute maximum peak current rating for the LEDs 100 may dissipate a large amount of power during normal operation and significantly reduce the efficiency of the system. To remedy this situation resistor 2606 may be replaced with a current limiter. A current limiter is a circuit that drops very little voltage when the current through the circuit is lower than a certain limit and will drop as much as the entire supply voltage when the current reaches the set limit.

Figure 27:
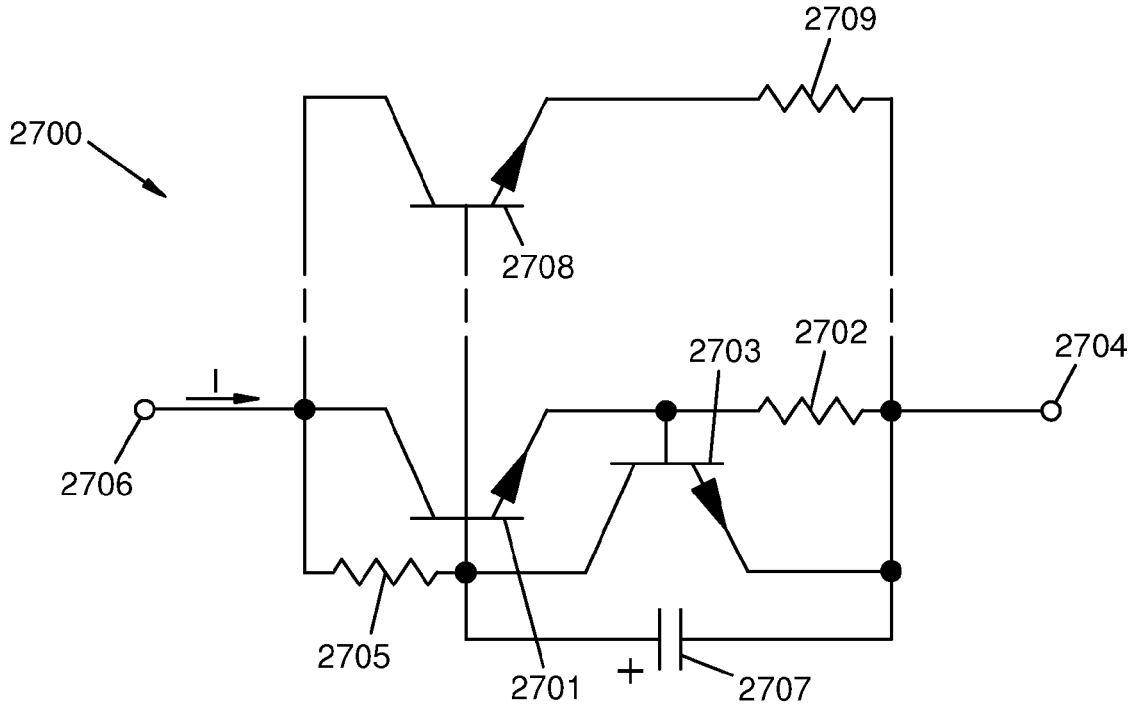
FIG. 27 is an electrical schematic diagram of an example of a current limiter that may be inserted into the circuit of FIG. 25 or the circuit of FIG. 26.

FIG. 27 shows an example of a current limiter 2700 that may be substituted for resistor 2606. Current limiter 2700 may include a blocking transistor 2701, which may have a feedback resistor 2702 connected in series with its emitter. A control transistor 2703 may have its input connected across feedback resistor 2702 such that the base of control transistor 2703 may be connected to the emitter of blocking transistor 2701 and the emitter of control transistor 2703 may be connected to output node 2704. The collector of control transistor 2703 may be connected to the base of blocking transistor 2701. Also connected to the base of blocking transistor 2701 may be a bias resistor 2705 the other end of which may be connected to input node 2706. The collector of blocking transistor 2701 may be connected to input node 2706. Feedback resistor 2702 may have one terminal connected to output node 2704. A capacitor 2707 may be connected between the collector and the emitter of control transistor 2703.

When current I through current limiter 2700 is below the limit current, the voltage drop across feedback resistor 2702 is too low to turn on control transistor 2703. Current flowing through bias resistor 2705 flows through the base-emitter junction of blocking transistor 2701 turning it on. If the resistance of bias resistor 2705 is low enough, only a small voltage drop is required across resistor 2705 to turn blocking transistor 2701 on to the point at which only a small voltage drop between the collector and the emitter of blocking transistor 2701 is required to carry the remainder of current I through this transistor. Meanwhile, the voltage drop across feedback resistor 2702 is lower than the base-emitter turn-on voltage of control transistor 2703. Therefore, the total voltage drop between input terminal 2706 and output terminal 2704, which is the sum of the collector-to-emitter voltage of blocking transistor 2701 and the voltage drop across feedback resistor 2702, may be small.

When current I through current limiter 2700 is at the limit current, the voltage drop across feedback resistor 2702 is high enough to turn on control transistor 2703 so that nearly all of the current through bias resistor 2705 may flow through the collector to the emitter of control transistor 2703 with a voltage drop from the collector to the emitter that is at or below the base-emitter turn-on voltage of blocking transistor 2701. In this case blocking transistor 2701 will not turn on any more than necessary to allow enough current through feedback resistor 2702 to produce a voltage drop across feedback resistor 2702 sufficient to turn on control transistor 2703.

Though in some applications it may not be necessary, capacitor 2707 may be included to prevent blocking transistors 2701 from turning on and passing high current due to charging currents in the collector-base capacitances of blocking transistor 2701 and currents through bias resistor 2705 occurring before control transistor 2703 has had time to turn on. Capacitor 2707 may delay and slow the turn-on of blocking transistor 2701 until deleterious transients have passed.

For current limiter 2700 to be effective as a current limiter, blocking transistor 2701 may require a collector-emitter breakdown voltage, at a collector current equal to the limit current, in excess of the highest voltage difference that may exist between input node 2706 and output node 2704. Blocking transistor 2701 may also have to withstand sufficiently high instantaneous power dissipation levels without undergoing second breakdown. If a single blocking transistor 2701 is not capable of handling sufficient instantaneous power levels, one or more auxiliary blocking transistors 2708 may be added to current limiter 2700 as shown in FIG. 27. The base of each auxiliary blocking transistor 2708 may be electrically connected to the base of blocking transistor 2701, and the collector of each auxiliary blocking transistor 2708 may be electrically connected to the collector of blocking transistor 2701. The emitter of each auxiliary blocking transistor 2708 may in some examples be electrically connected to the output node 2704. In other examples, the emitter of each auxiliary blocking transistor 2708 may be electrically connected to one terminal of an auxiliary feedback resistor 2709, the other terminal of which may be connected to output node 2704. If auxiliary blocking transistor 2708 is similar in characteristics to blocking transistor 2701 and the associated auxiliary feedback resistor 2709 has approximately the same resistance value as that of feedback resistor 2702, nearly equal amounts of current may flow through blocking transistor 2701 and each auxiliary blocking transistor 2708. As a consequence, the overall current I through current limiter 2700 may be approximately equally shared among blocking transistor 2701 and each auxiliary blocking transistor 2708, and the total instantaneous power dissipation in the blocking transistors may be approximately equally shared among blocking transistor 2701 and each auxiliary blocking transistor 2708. The maximum allowable instantaneous power dissipation of current limiter 2700 may then be proportional to the total number of blocking and auxiliary blocking transistors 2701 and 2708.

An additional requirement is that control transistor 2703 be capable of handling a peak collector current at least as high as the maximum current that may flow through resistor 2705. This maximum current may be approximately equal to the maximum voltage difference between input node 2706 and output node 2704 under current limiting conditions divided by the resistance of resistor 2705.

Though blocking transistor 2701, auxiliary blocking transistors 2708, and control transistor 2703 are shown as NPN bipolar junction transistors in FIG. 27, it will be clear to those skilled in the art of semiconductor electronics that other types of semiconductor devices may be utilized as well. PNP bipolar junction transistors may be used instead of NPN bipolar transistors, for example, if the connections of input node 2706 and output node 2704 to the external circuitry (FIG. 25 or FIG. 26) are interchanged. As another example, an enhancement-mode n-channel junction field effect transistor or a positive-threshold n-channel metal-oxide-semiconductor field effect transistor may be substituted for blocking transistor 2701 and auxiliary blocking transistors 2708 or for control transistor 2703 or for both. If a field effect transistor is used, the drain may be connected where the collector of a bipolar junction transistor would be connected, the gate may be connected where the base of a bipolar transistor would be connected, and the source may be connected where the emitter of a bipolar transistor would be connected.

In a preferred embodiment current limiter 2700 may be inserted into the described preferred embodiment of input-conditioned supply supply circuit 2600 in place of resistor 2606 with input node 2706 connected to the positive terminal of capacitor 2605 and output node 2704 connected to LED string 2604. A blocking transistor 2701 and one similar auxiliary blocking transistor 2708 of the NPN bipolar junction type may be used, each with a collector-emitter breakdown voltage rating in excess of 150 volts at a collector current of 0.25 amperes and in excess of 200 volts in the off state. The forward current transfer ratio of blocking transistor 2701 and auxiliary blocking transistor 2708 may be in excess of 50. Feedback resistor 2702 and auxiliary feedback resistor 2709 may each have a resistance value of 2.2 ohms and a continuous power dissipation rating of 0.25 watts. Bias resistor 2705 may have a resistance value of 220 ohms and a continuous power dissipation rating of 0.25 watts. Control transistor 2703 of the NPN bipolar junction type may have a collector current rating in excess of 3 amperes and a maximum power dissipation capability of at least 1 watt. Capacitor 2707 may have a capacitance value of 100 microfarads and a working voltage rating of 10 volts. The capacitance value of capacitor 2605 in input-conditioned supply supply circuit 2600 may be changed to 720 microfarads, and its maximum ripple current rating may exceed 0.3 amperes.

Supply circuit 2500 may benefit from insertion of a current limiter, as well. The high level of current I occurring prior to the heating of filament 2504 may damage LEDs 100. Inserting a current limiter in series with incandescent lamp 2501 in supply circuit 2500 may prevent current I from exceeding the absolute maximum current rating for LEDs 100.

A supply circuit of type 2500 or 2600, with or without the inclusion of a current limiter, may be operated off of a dimmer, such as a triac dimmer in series with the mains 2507 or 2602 respectively. Input-conditioned supply circuit 2600 may put less peak current stress on the dimmer than would supply circuit 2500.

Though examples have been described in which an incandescent lamp 2501 or 2601 is used in helping to control current to a load of LEDs 100, it will be clear to those skilled in the art that a nonlinear-resistance device other than an incandescent lamp may be utilized in place of incandescent lamp 2501 or 2601, and a load comprised of elements other than LEDs may benefit from the use of a supply circuit of type 2500 or 2600. Nonlinear-resistance devices that show increasing resistance with increasing current magnitude may include electrolytic cells or may include certain semiconductor devices or circuits incorporating semiconductor devices, for example. Loads other than LEDs may include discharge lamps, batteries, or electroplating tanks, for example.

In more general terms, a supply circuit may comprise: an output terminal for providing current to a load; a drive voltage terminal for receiving an electromotive force for driving current through a load; and a nonlinear resistive element with a first terminal electrically connected to the drive voltage terminal and a second terminal electrically connected to the output terminal, the nonlinear resistive element having a dynamic electrical resistance that varies with the magnitude of the electrical current through the nonlinear resistive element, the resistance tending to rise when the magnitude of the electrical current rises and to fall when the magnitude of the electrical current falls.

In further examples, the nonlinear resistive element may include a filament that is heated by electrical current flowing through the filament, which filament has a dynamic electrical resistance that increases as the filament rises in temperature and wherein, in some further examples, the nonlinear resistive element may be an incandescent lamp.

In further examples, the supply circuit may further comprise: a first alternating-current power terminal for providing alternating current to a circuit; a second alternating-current power terminal for returning alternating current from a circuit; a common terminal for returning current from a load; and a rectifier with a first alternating-current input terminal electrically connected to the first alternating-current power terminal, a second alternating-current input terminal electrically connected to the second alternating-current power terminal, a first direct-current output terminal electrically connected to the drive voltage terminal, and a second direct-current output terminal electrically connected to the common terminal. In this case, in further examples, the supply circuit may further comprise a filter capacitor one terminal of which is electrically connected to the drive voltage terminal and the other terminal of which is electrically connected to the common terminal; and/or may further comprise a line input terminal for receiving power from a power line, and a current-impeding circuit for limiting the magnitudes of current surges that may result from surges in voltage on a power line, the current-impeding circuit having a first terminal electrically connected to the line input terminal and a second terminal electrically connected to the first alternating-current power terminal. In the latter case, in further examples, the current-impeding circuit may include as an element a resistor, an inductor, a capacitor, a current limiter, or a series combination of two or more of these elements.

In the last case mentioned, in further examples, the current limiter may include: a current limiter input terminal; a current limiter output terminal; a current limiter control terminal; a current limiter feedback terminal; a blocking transistor having a control electrode electrically connected to the current limiter control terminal, an inverting electrode electrically connected to the current limiter input terminal, and a non-inverting electrode electrically connected to the current limiter feedback terminal; a control transistor having a control electrode electrically connected to the current limiter feedback terminal, an inverting electrode electrically connected to the current limiter control terminal, and a non-inverting electrode electrically connected to the current limiter output terminal; a feedback resistor having one terminal electrically connected to the current limiter feedback terminal and another terminal electrically connected to the current limiter output terminal; and a bias resistor having one terminal electrically connected to the current limiter input terminal and another terminal electrically connected to the current limiter control terminal. In addition, in further examples, the supply circuit may further comprise a capacitor having one terminal electrically connected to the current limiter control terminal and another terminal electrically connected to the current limiter output terminal; and/or the blocking transistor and the control transistor may each be one of an NPN bipolar junction transistor or an N-channel field effect transistor; and/or the blocking transistor and the control transistor may each be one of a PNP bipolar junction transistor or a P-channel field effect transistor; and/or the supply circuit may further comprise one or more auxiliary blocking circuits, each of which auxiliary blocking circuits is comprised of an auxiliary feedback terminal, an auxiliary blocking transistor having a control electrode electrically connected to the current limiter control terminal plus an inverting electrode electrically connected to the current limiter input terminal plus a non-inverting electrode electrically connected to the auxiliary blocking circuit's auxiliary feedback terminal, and an auxiliary feedback resistor having one terminal electrically connected to the auxiliary blocking circuit's auxiliary feedback terminal and another terminal electrically connected to the current limiter output terminal. In this latter case, in further examples, the auxiliary blocking transistor in each auxiliary blocking circuit may be substantially identical in characteristics to the blocking transistor, and the auxiliary feedback resistor in each auxiliary blocking circuit may be substantially identical in characteristics to the feedback resistor.

Alternatively, a supply circuit may comprise: an output terminal for providing current to a load; a common terminal for returning current from a load; a drive voltage terminal for receiving the electromotive force for driving current through a load; a surge-limiting circuit having a first terminal electrically connected to the drive voltage terminal and having a second terminal electrically connected to the output terminal, which surge-limiting circuit is capable of limiting the magnitudes of current surges that may result from temporary excesses in electromotive force between the drive voltage terminal and the common terminal; a first alternating-current power terminal for providing alternating current to a circuit; a second alternating-current power terminal for returning alternating current from a circuit; a rectifier with a first alternating-current input terminal electrically connected to the first alternating-current power terminal, a second alternating-current input terminal electrically connected to the second alternating-current power terminal, a first direct-current output terminal electrically connected to the drive voltage terminal, and a second direct-current output terminal electrically connected to the common terminal; a line input terminal for obtaining power from a power line; and a current-impeding circuit having one terminal electrically connected to the line input terminal and another terminal electrically connected to the first alternating-current power terminal, which current-impeding circuit is capable of limiting the magnitudes of current surges that may result from surges in the electric potential between the line input terminal and the second alternating-current power terminal, and which current-impeding circuit includes a nonlinear resistive element having a dynamic electrical resistance that varies with the magnitude of the electrical current through the nonlinear resistive element, the resistance tending to rise when the magnitude of the electrical current rises and to fall when the magnitude of the electrical current falls, and which current-impeding circuit causes to flow through the nonlinear resistive element most of the electrical current that flows through the current-impeding circuit from the line input terminal to the first alternating-current power terminal.

In further examples of this alternative supply circuit, the nonlinear resistive element may include a filament that is heated by electrical current flowing through the filament, which filament has a dynamic electrical resistance that increases as the filament rises in temperature. In this case, in further examples, the nonlinear resistive element may be an incandescent lamp.

In further examples of this alternative supply circuit, the supply circuit may further comprise a filter capacitor one terminal of which is electrically connected to the drive voltage terminal and the other terminal of which is electrically connected to the common terminal.

In further examples of this alternative supply circuit, the surge-limiting circuit may include as an element a resistor, an inductor, or a current limiter, or a series combination of two or more of these elements.

In the last case mentioned, in further examples, the current limiter may include: a current limiter input terminal; a current limiter output terminal; a current limiter control terminal; a current limiter feedback terminal; a blocking transistor having a control electrode electrically connected to the current limiter control terminal, an inverting electrode electrically connected to the current limiter input terminal, and a non-inverting electrode electrically connected to the current limiter feedback terminal; a control transistor having a control electrode electrically connected to the current limiter feedback terminal, an inverting electrode electrically connected to the current limiter control terminal, and a non-inverting electrode electrically connected to the current limiter output terminal; a feedback resistor having one terminal electrically connected to the current limiter feedback terminal and another terminal electrically connected to the current limiter output terminal; and a bias resistor having one terminal electrically connected to the current limiter input terminal and another terminal electrically connected to the current limiter control terminal. In addition, in further examples, the supply circuit may further comprise a capacitor having one terminal electrically connected to the current limiter control terminal and another terminal electrically connected to the current limiter output terminal; and/or the blocking transistor and the control transistor may each be one of an NPN bipolar junction transistor or an N-channel field effect transistor; and/or the blocking transistor and the control transistor may each be one of a PNP bipolar junction transistor or a P-channel field effect transistor; and/or the supply circuit may further comprise one or more auxiliary blocking circuits, each of which auxiliary blocking circuits is comprised of an auxiliary feedback terminal, an auxiliary blocking transistor having a control electrode electrically connected to the current limiter control terminal plus an inverting electrode electrically connected to the current limiter input terminal plus a non-inverting electrode electrically connected to the auxiliary blocking circuit's auxiliary feedback terminal, and an auxiliary feedback resistor having one terminal electrically connected to the auxiliary blocking circuit's auxiliary feedback terminal and another terminal electrically connected to the current limiter output terminal. In this latter case, in further examples, the auxiliary blocking transistor in each auxiliary blocking circuit may be substantially identical in characteristics to the blocking transistor, and the auxiliary feedback resistor in each auxiliary blocking circuit may be substantially identical in characteristics to the feedback resistor.

Accordingly, while embodiments have been particularly shown and described, many variations may be made therein. Other combinations of features, functions, elements, and/or properties may be used. Such variations, whether they are directed to different combinations or directed to the same combinations, whether different, broader, narrower, or equal in scope, are also included.

INDUSTRIAL APPLICABILITY

The methods and apparatus described in the present disclosure are applicable to lighting and other industries utilizing solid-state light-emitting devices such as LEDs for illumination.

What is claimed is:

1. A lamp assembly comprising:

a circuit board having an electrically insulating layer of material, a thermally conductive backing layer, and one or more electrically conductive traces disposed on a first major surface of the electrically insulating layer of material an opposing surface of which is in thermal contact with a surface of the thermally conductive backing layer;

one or more light-emitting devices disposed on the circuit board, in thermal contact with the circuit board, and in electrical contact with at least one of the electrically conductive traces;

a heat sink composed of thermally conductive material a surface of which is in thermal contact with the thermally conductive backing layer;

a gasket having a first surface, an opposing second surface, a hole, a gap, and a peripheral edge, the first surface being in mechanical contact with a surface of the circuit board, the hole penetrating from the first surface of the gasket through to the opposing second surface of the gasket, and the gap extending from an edge of the hole through to the peripheral edge of the gasket;

a bezel a surface of which is in mechanical contact with the second surface of the gasket;

an electrically conductive wire a first end of which is electrically connected to the circuit board and a second end of which is distal to the circuit board, the gasket, and the bezel, the electrically conductive wire disposed along and within the gap and passing from inside the hole to outside the peripheral edge of the gasket; and one or more fasteners configured to apply force between the bezel and the heat sink resulting in the application of pressure between the bezel and the gasket, between the gasket and the circuit board, and between the circuit board and the heat sink.

2. The lamp assembly according to claim 1, wherein the one or more fasteners include a screw or a rivet that either passes through or engages the bezel and either passes through or engages the heat sink.

3. The lamp assembly according to claim 1, wherein the one or more fasteners include a clamp or clamping mechanism, which clamp or clamping mechanism is activated by spring forces and not by the force of a screw mechanism.

4. The lamp assembly according to claim 1, wherein the one or more electrically conductive traces include a first electrically conductive trace continuous along, in proximity to, and spaced from an edge of the circuit board, which trace forms a border that separates a portion of the circuit board near the edge from a portion of the circuit board distal from the edge, which trace is not electrically connected to a light-emitting device, and the presence of which trace results in a raised portion of the circuit board, which raised portion is in contact with the gasket.

5. The lamp assembly according to claim 4, wherein the first electrically conductive trace is not electrically connected to any other electrical conductor.

6. The lamp assembly according to claim 1, further comprising an end axle mechanically attached to the heat sink and/or the bezel, the end axle including a shaft portion capable of being rotated in a bearing.

7. The lamp assembly according to claim 6, wherein the end axle includes a passageway along the axis of the shaft portion, through which passageway the electrically conductive wire passes.

8. The lamp assembly according to claim 6, wherein the end axle includes a first widened portion at a first end of the shaft portion and a second widened portion at a second end of the shaft portion, the first and second widened portions being integral with the shaft portion and not attached as separate pieces and each extending beyond the radius of the shaft portion in directions normal to the axis of the shaft portion.

9. The lamp assembly according to claim 8, wherein the first widened portion is suitably sized and shaped to be engaged directly by a human hand for the purpose of rotating the lamp about the axis of the shaft portion.

10. The lamp assembly according to claim 1, further comprising a tunnel having walls formed by the circuit board, the bezel, and the gasket, through which tunnel the electrically conductive wire passes, which walls completely surround a portion of the electrically conductive wire but which walls would not completely surround any portion of the electrically conductive wire if the bezel and the circuit board were absent, and wherein space in the tunnel not occupied by the electrically conductive wire is filled with a sealant to prevent flow of fluids through the tunnel.

11. The lamp assembly according to claim 10, wherein the sealant is a silicone rubber material.

12. The lamp assembly according to claim 1, wherein the bezel and the circuit board, both necessarily acting together, exert sufficient pressure from opposing sides on the electrically conductive wire extending through the gap to resist movement of the electrically conductive wire through the gap.

13. The lamp assembly according to claim 1, wherein the gasket is composed of a material that is reflective of light, its reflectivity being at least fifty percent.

14. The lamp assembly according to claim 1, wherein the gasket is composed of a silicone rubber compound.

15. The lamp assembly according to claim 14, wherein the silicone rubber compound contains particles that reflect light and cause the silicone rubber compound to reflect light, its reflectivity being at least fifty percent.

16. The lamp assembly according to claim 1, wherein a portion of the surface of the circuit board is coated with a coating substance that is reflective of light, its reflectivity being at least fifty percent.

17. The lamp assembly according to claim 16, wherein the coating substance includes a white or silver-colored solder-mask material.

18. The lamp assembly according to claim 16, wherein the coating substance includes a white or silver-colored silk-screen ink.

19. The lamp assembly according to claim 1, wherein the bezel includes a window configured to allow light emitted by a light-emitting device to escape from the lamp assembly.

20. The lamp assembly according to claim 19, wherein the edges of the window are beveled in a manner that reduces the amount of emitted light striking the bezel.

21. The lamp assembly according to claim 19, wherein the window is filled with a transparent material in such a way that fluids may not flow through the window to reach the light-emitting device or the circuit board.

22. The lamp assembly according to claim 21, wherein the transparent material makes optical contact to the light-emitting device and has an index of refraction between that of the surrounding atmosphere and that of the surface of the light-emitting device from which light is emitted.

23. The lamp assembly according to claim 21, wherein the transparent material is clear silicone rubber.

24. The lamp assembly according to claim 21, wherein the beveled surface is reflective of light, its reflectivity being at least fifty percent, and wherein the angle of the bevel is between 20 and 80 degrees with respect to the normal to the major plane of the window.

25. The lamp assembly according to claim 21, wherein the surface of the transparent material that is distal to the light-emitting device has a shape that through refraction distributes the light emerging from the lamp assembly over a wide range of angles.

26. The lamp assembly according to claim 25, wherein the surface of the transparent material that is distal to the light-emitting device has a shape that is flat, concave, meniscus-shaped, or multi-faceted.

27. The lamp assembly according to claim 21, wherein a portion of the transparent material contains light-scattering elements such as particles or bubbles.

28. The lamp assembly according to claim 1, wherein the bezel includes a window configured as a hole through the bezel to allow light emitted by a light-emitting device to escape from the lamp assembly.

29. A lamp array comprising a plurality of lamp assemblies, wherein:

the light-emitting devices in each lamp assembly are arranged in a line having a direction;

the lamp assemblies are positioned such that the direction of the line is substantially the same for all of the lamp assemblies;

the lamp assemblies are positioned in five or more rows in each of which row the lines in which the light-emitting devices are arranged in the lamp assemblies are collinear and every lamp assembly supplies illumination with the same spectral characteristic;

the spectral characteristic of the lamp assemblies in each row results in light of a distinct color, with the color of the light from a first row being substantially red, the color of the light from a second row being substantially red-orange, orange, or yellow, the color of the light from a third row being substantially green, the color of the light from a fourth row being substantially cyan, and the color of the light from a fifth row being substantially blue or blue-violet;

the rows are all substantially in the same plane, the numbered rows being positioned in numerical order from the first row to the fifth row.

30. The lamp array according to claim 29, wherein rows are spaced between two inches and twelve inches apart.

31. A supply circuit comprising:

an output terminal for providing current to a load;

a drive voltage terminal for receiving an electromotive force for driving current through a load;

a first alternating-current power terminal for providing alternating current to a circuit;

a second alternating-current power terminal for returning alternating current from a circuit;

a common terminal for returning current from a load;

a rectifier with a first alternating-current input terminal electrically connected to the first alternating-current power terminal, a second alternating-current input terminal electrically connected to the second alternating-current power terminal, a first direct-current output terminal electrically connected to the drive voltage terminal, and a second direct-current output terminal electrically connected to the common terminal; and a nonlinear resistive element with a first terminal electrically connected to the drive voltage terminal and a second terminal electrically connected to the output terminal, the nonlinear resistive element having a dynamic electrical resistance that varies with the magnitude of the electrical current through the nonlinear resistive element, the resistance tending to rise when the magnitude of the electrical current rises and to fall when the magnitude of the electrical current falls.

32. The supply circuit according to claim 31, wherein the nonlinear resistive element includes a filament that is heated by electrical current flowing through the filament, which filament has a dynamic electrical resistance that increases as the filament rises in temperature.

33. The supply circuit according to claim 32, wherein the nonlinear resistive element is an incandescent lamp.

34. The supply circuit according to claim 31, further comprising:

a filter capacitor one terminal of which is electrically connected to the drive voltage terminal and the other terminal of which is electrically connected to the common terminal.

35. The supply circuit according to claim 31, further comprising:

a line input terminal for receiving power from a power line; and a current-impeding circuit for limiting the magnitudes of current surges that may result from surges in voltage on a power line, the current-impeding circuit having a first terminal electrically connected to the line input terminal and a second terminal electrically connected to the first alternating-current power terminal.

36. The supply circuit according to claim 35, wherein the current-impeding circuit includes as an element a resistor, an inductor, a capacitor, a current limiter, or a series combination of two or more of these elements.

37. The supply circuit according to claim 35, wherein the current-impeding circuit includes as an element a resistor, a capacitor, a current limiter, or a series combination of two or more of these elements but does not include an element that is primarily an inductor.

38. A supply circuit comprising:

an output terminal for providing current to a load;

a drive voltage terminal for receiving an electromotive force for driving current through a load;

a first alternating-current power terminal for providing alternating current to a circuit;

a second alternating-current power terminal for returning alternating current from a circuit;

a common terminal for returning current from a load;

a rectifier with a first alternating-current input terminal electrically connected to the first alternating-current power terminal, a second alternating-current input terminal electrically connected to the second alternating-current power terminal, a first direct-current output terminal electrically connected to the drive voltage terminal, and a second direct-current output terminal electrically connected to the common terminal;

a nonlinear resistive element with a first terminal electrically connected to the drive voltage terminal and a second terminal electrically connected to the output terminal, the nonlinear resistive element having a dynamic electrical resistance that varies with the magnitude of the electrical current through the nonlinear resistive element, the resistance tending to rise when the magnitude of the electrical current rises and to fall when the magnitude of the electrical current falls;

a line input terminal for receiving power from a power line; and a current-impeding circuit for limiting the magnitudes of current surges that may result from surges in voltage on a power line, the current-impeding circuit having a first terminal electrically connected to the line input terminal and a second terminal electrically connected to the first alternating-current power terminal, wherein the current-impeding circuit includes a current limiter connected in series with a resistor, an inductor, a capacitor, or a series combination of two or more of these elements;

wherein the current limiter includes a current limiter input terminal;

a current limiter output terminal;

a current limiter control terminal;

a current limiter feedback terminal;

a blocking transistor having a control electrode electrically connected to the current limiter control terminal, an inverting electrode electrically connected to the current limiter input terminal, and a non-inverting electrode electrically connected to the current limiter feedback terminal;

a control transistor having a control electrode electrically connected to the current limiter feedback terminal, an inverting electrode electrically connected to the current limiter control terminal, and a non-inverting electrode electrically connected to the current limiter output terminal;

a feedback resistor having one terminal electrically connected to the current limiter feedback terminal and another terminal electrically connected to the current limiter output terminal; and a bias resistor having one terminal electrically connected to the current limiter input terminal and another terminal electrically connected to the current limiter control terminal.

39. The supply circuit according to claim 38, further comprising a capacitor having one terminal electrically connected to the current limiter control terminal and another terminal electrically connected to the current limiter output terminal.

40. The supply circuit according to claim 38, further comprising one or more auxiliary blocking circuits, each of which auxiliary blocking circuits is comprised of:

an auxiliary feedback terminal;

an auxiliary blocking transistor having a control electrode electrically connected to the current limiter control terminal, an inverting electrode electrically connected to the current limiter input terminal, and a non-inverting electrode electrically connected to the auxiliary blocking circuit's auxiliary feedback terminal; and an auxiliary feedback resistor having one terminal electrically connected to the auxiliary blocking circuit's auxiliary feedback terminal and another terminal electrically connected to the current limiter output terminal.

41. The supply circuit according to claim 40, wherein the auxiliary blocking transistor in each auxiliary blocking circuit is substantially identical in characteristics to the blocking transistor, and the auxiliary feedback resistor in each auxiliary blocking circuit is substantially identical in characteristics to the feedback resistor.

42. The supply circuit according to claim 38, wherein the blocking transistor and the control transistor are each one of an NPN bipolar junction transistor or an N-channel field effect transistor.

43. The supply circuit according to claim 38, wherein the blocking transistor and the control transistor are each one of a PNP bipolar junction transistor or a P-channel field effect transistor.

44. A supply circuit comprising:

an output terminal for providing current to a load;

a common terminal for returning current from a load;

a drive voltage terminal for receiving the electromotive force for driving current through a load;

a surge-limiting circuit having a first terminal electrically connected to the drive voltage terminal and having a second terminal electrically connected to the output terminal, which surge-limiting circuit is capable of limiting the magnitudes of current surges that may result from temporary excesses in electromotive force between the drive voltage terminal and the common terminal;

a first alternating-current power terminal for providing alternating current to a circuit;

a second alternating-current power terminal for returning alternating current from a circuit;

a rectifier with a first alternating-current input terminal electrically connected to the first alternating-current power terminal, a second alternating-current input terminal electrically connected to the second alternating-current power terminal, a first direct-current output terminal electrically connected to the drive voltage terminal, and a second direct-current output terminal electrically connected to the common terminal;

a line input terminal for obtaining power from a power line; and a current-impeding circuit having one terminal electrically connected to the line input terminal and another terminal electrically connected to the first alternating-current power terminal, which current-impeding circuit is capable of limiting the magnitudes of current surges that may result from surges in the electric potential between the line input terminal and the second alternating-current power terminal, and which current-impeding circuit includes a nonlinear resistive element having a dynamic electrical resistance that varies with the magnitude of the electrical current through the nonlinear resistive element, the resistance tending to rise when the magnitude of the electrical current rises and to fall when the magnitude of the electrical current falls, and which current-impeding circuit causes to flow through the nonlinear resistive element most of the electrical current that flows through the current-impeding circuit from the line input terminal to the first alternating-current power terminal.

45. The supply circuit according to claim 44, wherein the nonlinear resistive element includes a filament that is heated by electrical current flowing through the filament, which filament has a dynamic electrical resistance that increases as the filament rises in temperature.

46. The supply circuit according to claim 45, wherein the nonlinear resistive element is an incandescent lamp.

47. The supply circuit according to claim 44, further comprising a filter capacitor one terminal of which is electrically connected to the drive voltage terminal and the other terminal of which is electrically connected to the common terminal.

48. The supply circuit according to claim 44, wherein the surge-limiting circuit includes as an element a resistor, an inductor, or a current limiter, or a series combination of two or more of these elements.

49. The supply circuit according to claim 44, wherein the surge-limiting circuit includes as an element a resistor, a current limiter, or a series combination of two or more of these elements but does not include an element that is primarily an inductor.

50. A supply circuit comprising:

an output terminal for providing current to a load;

a common terminal for returning current from a load;

a drive voltage terminal for receiving the electromotive force for driving current through a load;

a surge-limiting circuit having a first terminal electrically connected to the drive voltage terminal and having a second terminal electrically connected to the output terminal, which surge-limiting circuit is capable of limiting the magnitudes of current surges that may result from temporary excesses in electromotive force between the drive voltage terminal and the common terminal, wherein the surge-limiting circuit includes as an element a current limiter connected in series with a resistor, an inductor, or a series combination of two or more of these elements;

a first alternating-current power terminal for providing alternating current to a circuit;

a second alternating-current power terminal for returning alternating current from a circuit;

a rectifier with a first alternating-current input terminal electrically connected to the first alternating-current power terminal, a second alternating-current input terminal electrically connected to the second alternating-current power terminal, a first direct-current output terminal electrically connected to the drive voltage terminal, and a second direct-current output terminal electrically connected to the common terminal;

a line input terminal for obtaining power from a power line; and a current-impeding circuit having one terminal electrically connected to the line input terminal and another terminal electrically connected to the first alternating-current power terminal, which current-impeding circuit is capable of limiting the magnitudes of current surges that may result from surges in the electric potential between the line input terminal and the second alternating-current power terminal, and which current-impeding circuit includes a nonlinear resistive element having a dynamic electrical resistance that varies with the magnitude of the electrical current through the nonlinear resistive element, the resistance tending to rise when the magnitude of the electrical current rises and to fall when the magnitude of the electrical current falls, and which current-impeding circuit causes to flow through the nonlinear resistive element most of the electrical current that flows through the current-impeding circuit from the line input terminal to the first alternating-current power terminal;

wherein the current limiter includes a current limiter input terminal;

a current limiter output terminal;

a current limiter control terminal;

a current limiter feedback terminal;

a blocking transistor having a control electrode electrically connected to the current limiter control terminal, an inverting electrode electrically connected to the current limiter input terminal, and a non-inverting electrode electrically connected to the current limiter feedback terminal;

a control transistor having a control electrode electrically connected to the current limiter feedback terminal, an inverting electrode electrically connected to the current limiter control terminal, and a non-inverting electrode electrically connected to the current limiter output terminal;

a feedback resistor having one terminal electrically connected to the current limiter feedback terminal and another terminal electrically connected to the current limiter output terminal; and a bias resistor having one terminal electrically connected to the current limiter input terminal and another terminal electrically connected to the current limiter control terminal.

51. The supply circuit according to claim 50, further comprising a capacitor having one terminal electrically connected to the current limiter control terminal and another terminal electrically connected to the current limiter output terminal.

52. The supply circuit according to claim 50, further comprising one or more auxiliary blocking circuits, each of which auxiliary blocking circuits comprises:

an auxiliary feedback terminal;

an auxiliary blocking transistor having a control electrode electrically connected to the current limiter control terminal, an inverting electrode electrically connected to the current limiter input terminal, and a non-inverting electrode electrically connected to the auxiliary blocking circuit's auxiliary feedback terminal; and an auxiliary feedback resistor having one terminal electrically connected to the auxiliary blocking circuit's auxiliary feedback terminal and another terminal electrically connected to the current limiter output terminal.

53. The supply circuit according to claim 52, wherein the auxiliary blocking transistor in each auxiliary blocking circuit is substantially identical in characteristics to the blocking transistor, and the auxiliary feedback resistor in each auxiliary blocking circuit is substantially identical in characteristics to the feedback resistor.

54. The supply circuit according to claim 50, wherein the blocking transistor and the control transistor are each one of an NPN bipolar junction transistor or an N-channel field effect transistor.

55. The supply circuit according to claim 50, wherein the blocking transistor and the control transistor are each one of a PNP bipolar junction transistor or a P-channel field effect transistor.

* * * * *